US006835512B2

(12) United States Patent
Morikawa et al.

(10) Patent No.: US 6,835,512 B2
(45) Date of Patent: Dec. 28, 2004

(54) ELECTROPHOTOGRAPHIC PHOTOSENSITIVE MEMBER, PROCESS CARTRIDGE AND ELECTROPHOTOGRAPHIC APPARATUS

(75) Inventors: Yosuke Morikawa, Kanagawa (JP); Tatsuya Ikezue, Kanagawa (JP); Kouichi Nakata, Shizuoka (JP); Kimihiro Yoshimura, Kanagawa (JP); Daisuke Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 10/322,732

(22) Filed: Dec. 19, 2002

(65) Prior Publication Data

US 2003/0186145 A1 Oct. 2, 2003

(30) Foreign Application Priority Data

Dec. 21, 2001 (JP) ..... 2001/389241

(51) Int. Cl.[7] ..... G03G 5/047

(52) U.S. Cl. ..... 430/58.05; 430/58.65; 430/58.8; 430/59.6; 430/66; 399/176

(58) Field of Search ..... 430/58.05, 58.65, 430/58.8, 59.6, 66; 399/176, 159

(56) References Cited

U.S. PATENT DOCUMENTS

| | | | | |
|---|---|---|---|---|
| 4,148,637 | A | 4/1979 | Kubota et al. | 96/1.5 N |
| 5,330,873 | A | 7/1994 | Doi et al. | 430/133 |
| 5,606,401 | A | 2/1997 | Yano | 355/219 |
| 6,492,081 | B2 * | 12/2002 | Morikawa et al. | 430/66 |

FOREIGN PATENT DOCUMENTS

| | | |
|---|---|---|
| JP | 5173350 | 7/1993 |
| JP | 7005748 | 1/1995 |

* cited by examiner

*Primary Examiner*—John L Goodrow
(74) *Attorney, Agent, or Firm*—Fitzpatrick, Cella, Harper & Scinto

(57) ABSTRACT

An electrophotographic photosensitive member is disclosed in which a photosensitive layer and a protective layer are formed on a conductive substrate in that order. In this photosensitive member, when its surface is charged to −700 V under a 23° C./5% RH environment and irradiated with white light in a light quantity of 10 lux·sec, if the surface potential at the time 0.2 seconds have passed from the irradiation and the surface potential at the time 0.5 seconds have passed from the irradiation are defined as Vsl(0.2) and Vsl(0.5), respectively, the absolute value of Vsl(0.2) and the absolute value of Vsl(0.2)−Vsl(0.5) satisfy specific conditions.

7 Claims, 4 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus. More particularly, it relates to an electrophotographic photosensitive member having on a conductive support at least a charge generation layer, a charge transport layer and a protective layer in this order, and a process cartridge and an electrophotographic apparatus which have such an electrophotographic photosensitive member.

2. Related Background Art

In recent years, electrophotographic photosensitive members are required to be made further durable. For example, Japanese Patent Application Laid-open No. 5-173350 discloses that an electrophotographic photosensitive member having very good durability can be provided by forming on a photosensitive layer a protective layer which contains a curable resin. As another example, Japanese Patent Application Laid-open No. 7-5748 discloses what is called injection charging, in which electric charges are injected into a protective layer on a photosensitive layer without being accompanied with any substantial discharge.

However, while an electrophotographic photosensitive member having a protective layer has the above-mentioned advantages, positive ghosts or negative ghosts are liable to occur. In addition, such phenomena become conspicuous particularly in a case where the protective layer contains a curable resin as a binder resin.

On the other hand, with the recent development of full-color photography or the minuteness realized by dots as small as 1,200 dpi (dot per inch), much higher image quality is demanded.

SUMMARY OF THE INVENTION

An object of the present invention is to provide an electrophotographic photosensitive member which hardly causes positive ghosts or negative ghosts even in repeated use and can stably provide high grade images.

In addition, other objects of the present invention are to provide a process cartridge and an electrophotographic apparatus having the electrophotographic photosensitive member.

That is, the present invention provides an electrophotographic photosensitive member comprising, in this order, a photosensitive layer and a protective layer on a conductive substrate, wherein the surface of the electrophotographic photosensitive member is charged to −700 V and irradiated with white light in a light quantity of 10 lux·sec under a 23° C./5% RH environment, where Vsl(0.2), which is a surface potential of the electrophotographic photosensitive member at the time 0.2 seconds have passed from the irradiation, satisfies the following formula (1) and the difference between the Vsl(0.2) and Vsl(0.5), which is a surface potential of the electrophotographic photosensitive member at the time 0.5 seconds have passed from the irradiation, satisfies the following formula (2):

$$20(V) \leqq |Vsl(0.2)| \leqq 80(V) \quad (1)$$

$$10(V) \leqq |Vsl(0.2) - Vsl(0.5)| \leqq 30(V) \quad (2).$$

The present invention further provides a process cartridge and an electrophotographic apparatus having the above electrophotographic photosensitive member.

DETAILED DESCRIPTION OF THE PREFERRED EMBODIMENTS

Figure 1A:
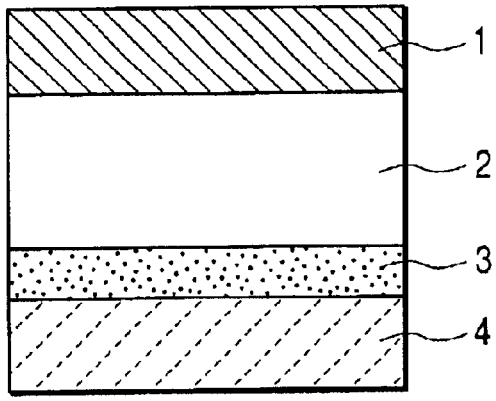
FIGS. 1A, 1B and 1C are sectional views showing examples of the layer construction of the electrophotographic photosensitive member according to the present invention.

In the present invention, Vsl(0.2), which is a surface potential of the electrophotographic photosensitive member at the time 0.2 seconds have passed after the surface of the electrophotographic photosensitive member is charged to −700 V and irradiated with white light in a light quantity of 10 lux·sec under a 23° C./5% RH environment, satisfies the following formula (1), and the difference between the Vsl (0.2) and Vsl(0.5), which is a surface potential of the electrophotographic photosensitive member at the time 0.5 seconds have passed after the irradiation with the white light, satisfies the following formula (2):

$$20(V) \leqq |Vsl(0.2)| \leqq 80(V) \quad (1)$$

$$10(V) \leqq |Vsl(0.2) - \mathrm{Vsl}(0.5)| \leqq 30(V) \quad (2).$$

Embodiments of the present invention will be described below in detail.

As stated above, in the electrophotographic photosensitive member having a protective layer, there was such problems that positive ghosts or negative ghosts were liable to occur, and blurred images tended to occur under high temperature and high humidity environment, with such phenomena conspicuously appearing particularly in a case where the protective layer contains a curable resin as a binder resin.

The present inventors presumed that these problems were ascribable to electric charges accumulated at the interface formed between the charge transport layer and the protective layer.

In recent years, research and development on protective layers of electrophotographic photosensitive members is progressing at dizzy speed, but there is no change in that the interface is formed between the photosensitive layer and the protective layer. Such a tendency is strong especially where a curable resin is used in the protective layer.

Charges generated in the photosensitive layer move through the photosensitive layer to reach the above interface and enter the protective layer, but some charges are supposed usually to accumulate at the interface. The present inventors presumed that the above positive and negative ghosts would be caused by the charge accumulation at the interface.

That is, in the case of an electrophotographic photosensitive member having a protective layer, charges having moved through the photosensitive layer after exposure reach the interface between the photosensitive layer and the protective layer to be accumulated, or stay in the protective layer. In such a place, when the second round charging is conducted, the absolute value of the surface potential is reduced by the influence of the accumulated or stayed charges, appearing as positive ghosts when half-tone images are reverse-developed.

On the other hand, if the above accumulated or stayed charges are further remarkable, a lot of charges are left accumulated or stayed even when the second round charging is carried out, and due to the influence of the previously accumulated or stayed charges together with the influence of charge accumulation and stay newly caused by exposure for forming half-tone images, the absolute value of the surface potential is not sufficiently reduced, appearing as negative ghosts when half-tone images are reverse-developed.

Therefore, the present inventors found that the above-described technical subject can be solved by delicately controlling the above accumulated or stored charges, specifically by regulating the potential characteristics of the electrophotographic photosensitive member so that the conditions represented by the above formulas (1) and (2) are satisfied and arrived at the present invention. The present inventors have performed various studies from the above viewpoints, and based on their experience, derived the above formulas (1) and (2) in the present invention.

The characteristics of the electrophotographic photosensitive member according to the present invention is defined by the surface potential of the electrophotographic photosensitive member after charging the surface of the electrophotographic photosensitive member to −700 V and irradiating the charged surface with white light in the light quantity of 10 lux·sec.

In the present invention, the residual potential $|Vsl(0.2)|$ at the time 0.2 seconds have passed after the irradiation with the white light is 20 V or more and 80 V or less, preferably 20 V or more and 70 V or less, and particularly 20 V or more and 60 V or less. If the $|Vsl(0.2)|$ is less than 20 V, positive ghosts are liable to occur, and if the $|Vsl(0.2)|$ is more than 80 V, negative ghosts are liable to occur.

However, it is not sufficient to define only the range of the $|Vsl(0.2)|$, and in the present invention it is further necessary that the difference between the Vsl(0.2) and the residual potential Vsl(0.5) at the time 0.5 seconds have passed after the irradiation with the white light ($|Vsl(0.2)-Vsl(0.5)|$) is 10 V or more and 30 V or less. If the $|Vsl(0.2)-Vsl(0.5)|$ is less than 10 V, the attenuation in a short time of the potential is too small, i.e., charges are liable to accumulate or stay, and in the case of reverse development, negative ghosts would occur. On the other hand, if the $|Vsl(0.2)-Vsl(0.5)|$ is more than 30 V, the attenuation in a short time of the potential is too large, i.e., the absolute value of the surface potential at the time of the second charging becomes too low, resulting in positive ghosts. In the present invention, the $|Vsl(0.2)-Vsl(0.5)|$ is preferably 12 V or more and 25 V or less.

These surface potentials were measured under the 23° C./5% RH environment. By evaluating the state of the accumulation or stay of charges under such a low humidity, more substantial electrophotographic characteristics can be evaluated.

From the interface viewpoint, the constitution of the protective layer is cited as a factor having a great influence on the afore-mentioned potential characteristics. Such a constitution of the protective layer includes kinds of compounds contained in therein, the composition rate thereof, the cross-liking degree of a binder resin, the thickness thereof, and types and mixing ratio of compounds contained in the photosensitive member, but in the present invention, it is important that the electrophotographic photosensitive member has the afore-mentioned potential characteristics and measures for realizing such characteristics is not particularly limited.

However, there are preferred embodiments for realizing the above potential characteristics, hence the constitution thereof is described below in detail.

The protective layer of the electrophotographic photosensitive member according to the present invention may preferably be a layer containing a binder resin and at least one of conductive particles and a charge-transporting material.

As the binder resin for the protective layer, curable resins are preferred. In particular, phenolic resins, epoxy resins and siloxane resins are more preferred. Still in particular, phenolic resins are preferred because the electrical resistance of the protective layer may less undergo environmental variations. Then, particularly more preferred are heat-curable resol type phenolic resins in view of advantages that they can provide a high surface hardness, promise superior wear resistance and also afford superior dispersibility for fine particles and superior stability after their dispersion.

Curable phenolic resins are resin obtained commonly by the reaction of phenolics with formaldehyde.

The phenolic resins have two types, and are divided into a resol type obtained by the reaction of a phenolic with formaldehyde, the latter being used in excess in respect to the former, in the presence of an alkali catalyst, and a novolak type obtained by the reaction of a phenolic with formaldehyde, the former being used in excess in respect to the latter, in the presence of an acid catalyst.

The resol type is soluble in alcohol type solvents and also in ketone type solvents. It undergoes three-dimensionally cross-linking polymerization upon heating, and comes into a cured product. As for the novolak type, it usually does not cure when heated as it is, but forms a cured product upon heating with addition of a formaldehyde source such as paraformaldehyde or hexamethylenetetramine.

Commonly and industrially, the resol type is utilized in coating materials, adhesives, castings and laminating varnishes. The novolak type is chiefly utilized in molding materials and binders.

In the present invention, either of the resol type and the novolak type may be used as the phenolic resins. In view of the ability to cure without addition of any curing agent and the operability as coating materials, it is preferable to use the resol type.

Where the phenolic resins are used in the present invention, any of phenolic resins may be used alone or in the form of a mixture of two or more. It is also possible to use the resol type and the novolak type in combination. Also, any known phenolic resins may be used.

Resol type phenolic resins are usually produced by reacting phenolic compounds with aldehyde compounds in the presence of an alkali catalyst.

Chief phenolic compounds to be used may include, but are not limited to, phenol, cresol, xylenol, para-alkylphenols, para-phenylphenol, resorcin and bisphenols. The aldehyde compounds may also include, but are not limited to, formaldehyde, paraformaldehyde, furfural and acetaldehyde.

These phenolic compounds and aldehyde compounds may be allowed to react in the presence of an alkali catalyst to produce any of monomers of monomethylolphenols, dimethylolphenols or trimethylolphenols, mixtures of these, or those obtained by making them into oligomers, and mixtures of these monomers and oligomers. Of these, relatively large molecules having about 2 to 20 repeating units of molecular structure are the oligomers, and those having a single unit are the monomers.

The alkali catalyst to be used may include metal type alkali compounds and amine compounds. The metal type alkali compounds may include, but are not limited to, alkali metal or alkaline earth metal hydroxides such as sodium hydroxide, potassium hydroxide and calcium hydroxide. The amine compounds may include, but are not limited to, ammonia, hexamethylenetetramine, trimethylamine, triethylamine and triethanolamine.

In the present invention, taking account of variations of electrical resistance in an environment of high humidity, amine compounds may preferably be used, and, taking account of other electrophotographic performances, may also be used in the form of a mixture with any of the metal type alkali compounds.

The protective layer of the electrophotographic photosensitive member according to the present invention may preferably be formed by coating on the photosensitive layer a coating solution prepared by dissolving the curable phenolic resin in, or diluting it with, a solvent or the like, whereby polymerization reaction takes place after coating and a cured layer is formed. The polymerization proceeds by addition and condensation reaction caused by heating, where the protective layer is formed by coating, followed by heating to cause polymerization reaction to take place to form a polymeric cured layer in which the resin has cured.

In the present invention, what is meant by "the resin has cured" is that the resin stands insoluble even when wetted with an alcohol solvent such as methanol or ethanol.

The conductive particles for the protective layer have an auxiliary function to control the volume resistivity of the protective layer, and need not necessarily be used if unnecessary.

The conductive particles usable in the protective layer of the electrophotographic photosensitive member according to the present invention may include metal particles and metal oxide particles.

The metal particles may include aluminum, zinc, copper, chromium, nickel, silver and stainless steel particles, or particles of plastic on the surfaces of which any of these metals has been vacuum-deposited. The metal oxide particles may include zinc oxide, titanium oxide, tin oxide, antimony oxide, indium oxide, bismuth oxide, tin-doped indium oxide, antimony- or tantalum-doped tin oxide, and antimony-doped zirconium oxide particles.

Any of these may be used alone or may be used in combination of two or more types. When used in combination of two or more types, they may merely be blended or may be made into a solid solution or a fused solid.

In the present invention, among the conductive particles described above, the use of metal oxides is preferred in view of the transparency. Of these metal oxides, the use of tin oxide is further particularly preferred. The tin oxide may be, for the purpose of improving dispersibility and liquid stability, one having been subjected to surface treatment described later, or may be, for the purpose of improving resistance controllability, one having been doped with antimony or tantalum.

The conductive particles for the protective layer may preferably have an average particle diameter of 0.3 $\mu$m or less, and particularly 0.1 $\mu$m or less, from the viewpoint of transparency of the protective layer. On the other hand, from the viewpoint of dispersibility and dispersion stability, they may preferably have an average particle diameter of 0.001 $\mu$m or more.

From the viewpoint of film strength of the protective layer, the protective layer comes weaker with an increase in the quantity of the conductive particles. Accordingly, the conductive particles may preferably be in a small quantity as long as the volume resistivity and residual potential of the protective layer are tolerable.

The protective layer of the electrophotographic photosensitive member according to the present invention may also preferably be a layer containing lubricating particles The lubricating particles for the protective layer may preferably include fluorine-atom-containing resin particles, silicone resin particles, silica particles and alumina particles, and more preferably be fluorine-atom-containing resin particles. Also, two or more kinds of these may be blended.

The fluorine-atom-containing resin particles may include particles of tetrafluoroethylene resin, trifluorochloroethylene resin, hexafluoroethylene propylene resin, vinyl fluoride resin, vinylidene fluoride resin, difluorodichloroethylene resin and copolymers of these, any one or more of which may preferably appropriately be selected. Tetrafluoroethylene resin particles and vinylidene fluoride resin particles are particularly preferred.

The molecular weight and particle diameter of the lubricating particles may appropriately be selected, without any particular limitations. Preferably, they may have a molecular weight of from 3,000 to 5,000,000, and an average particle diameter of from 0.01 $\mu$m to 10 $\mu$m, and more preferably from 0.05 $\mu$m to 2.0 $\mu$m.

Inorganic particles such as silica particles and alumina particles do not function as the lubricating particles in themselves in some cases. However, studies made by the present inventors have revealed that by dispersing and adding those particles, the protective layer have a larger surface roughness, and consequently can have an improved lubricity. In the present invention, the lubricating particles are meant to include particles capable of providing lubricity.

When the conductive particles and the lubricating particles such as fluorine-atom-containing resin particles are dispersed together in a resin solution, in order to make these particles not undergo mutual agglomeration, the fluorine-atom-containing compound may be added at the time the conductive particles are dispersed, or the conductive particles may be surface-treated with the fluorine-containing compound.

Compared with a case in which any fluorine-atom-containing compound is not added, the addition of the fluorine-atom-containing compound to the conductive particles or the surface treatment of the latter with the former brings about a remarkable improvement in dispersibility and dispersion stability of the conductive particles and fluorine-atom-containing resin particles in the resin solution.

The fluorine-atom-containing resin particles may also be dispersed in a liquid dispersion in which the fluorine-atom-containing compound has been added and the conductive particles have been dispersed, or in a liquid dispersion in which the surface-treated conductive particles have been dispersed. This enables preparation of a protective-layer coating fluid free of any formation of secondary particles of dispersed particles, very stable over time and having a good dispersion.

The fluorine-atom-containing compound may include fluorine-containing silane coupling agents, fluorine-modified silicone oils and fluorine type surface-active agents. Examples of preferred compounds are given below. In the present invention, examples are by no means limited to these compounds.

Examples of fluorine-containing silane coupling agents $CF_3CH_2CH_2Si(OCH_3)_3$ $C_4F_9CH_2CH_2Si(OCH_3)_3$ $C_6F_{13}CH_2CH_2Si(OCH_3)_3$ $C_8F_{17}CH_2CH_2Si(OCH_3)_3$ $C_8F_{17}CH_2CH_2Si(OCH_2CH_2OCH_3)_3$ $C_{10}F_{21}Si(OCH_3)_3$ $C_6F_{13}CONHSi(OCH_3)_3$ $C_8F_{17}CONHSi(OCH_3)_3$ $C_7F_{15}CONHCH_2CH_2CH_2Si(OCH_3)_3$ $C_7F_{15}CONHCH_2CH_2CH_2Si(OC_2H_5)_3$ $C_7F_{15}COONHCH_2CH_2CH_2Si(OCH_3)_3$ $C_7F_{15}COSNHCH_2CH_2CH_2Si(OCH_3)_3$ $C_7F_{15}SO_2NHCH_2CH_2CH_2Si(OC_2H_5)_3$ $C_8F_{17}SO_2N(CH_2CH_2CH_3)CH_2CH_2CH_2Si(OCH_3)_3$ $C_8F_{17}CH_2CH_2SCH_2CH_2Si(OCH_3)_3$ $C_{10}F_{21}CH_2CH_2SCH_2CH_2Si(OCH_3)_3$ $C_7F_{15}CONH(COC_7F_{15})CH_2CH_2NCH_2CH_2CH_2Si(OCH_3)_3$ $C_7F_{15}SO_2NHCH_2CH_2N(SO_2C_8F_{17})CH_2CH_2CH_2Si(OCH_3)_3$ Examples of fluorine-modified silicone oils

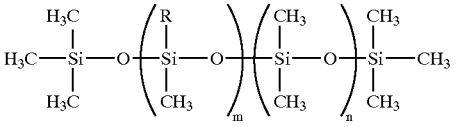

R: $-CH_2CH_2CF_3$ m and n: positive integers

Examples of fluorine type surface-active agents $X-SO_2NRCH_2COOH$ $X-SO_2NRCH_2CH_2O(CH_2CH_2O)_nH$ $X-SO_2N(CH_2CH_2CH_2OH)_2$ $X-RO(CH_2CH_2O)_nH$ $X-(RO)_nH$ $X-(RO)_nR$ $X-SO_2NRCH_2CH(O)CH_2$ $X-COOH$, $X-CH_2CH_2COOH$ $X-ORCOOH$ $X-ORCH_2COOH$, $X-SO_3H$ $X-ORSO_3H$, $X-CH_2CH_2OH$ $X-CH_2OCH_2CH(O)CH_2$ $X-CH_2CH_2OCH_2CH(O)CH_2$ $X-CO_2CH_2CH(O)CH_2$ R: alkyl group, aryl group or aralkyl group.
X: fluorocarbon group such as $-CF_3$, $-C_4F_8$ or $-C_8F_{17}$.
n: 5, 10 or 15

As a method for the surface treatment of the conductive particles, the conductive particles and the surface-treating agent may be mixed and dispersed in a suitable solvent to make the surface-treating agent adhere to the conductive-particle surfaces. They may be dispersed by using a usual dispersion means such as a ball mill or a sand mill. Next, the solvent may be removed from the resultant liquid dispersion to fix the surface-treating agent to the conductive-particle surfaces.

After this treatment, heat treatment may further optionally be made. Also, in the surface-treating dispersion, a catalyst for accelerating the reaction may be added. Still also, the conductive particles having been surface-treated may further optionally be subjected to pulverization.

The proportion of the fluorine-atom-containing compound to the conductive particles is influenced by the particle diameter, shape and surface area of the particles to be treated, and the former may preferably be in an amount of from 1 to 65% by weight, and more preferably from 1 to 50% by weight, based on the total weight of the conductive particles having been surface-treated.

In the present invention, in order to provide a protective layer having a higher environmental stability, a siloxane compound having structure represented by the following Formula (1) may further be added at the time the conductive particles are dispersed, or conductive particles having been surface-treated with the siloxane compound having structure represented by the following Formula (1) may further be mixed. This enables the protective layer having much higher environmental stability to be formed.

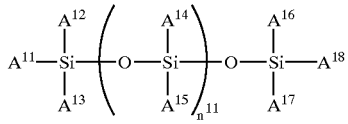

(1)

In Formula (1), $A^{11}$ to $A^{18}$ are each independently a hydrogen atom or a methyl group, provided that the proportion of the total number (b) of the hydrogen atoms in the total number (a) of A's, b/a, ranges from 0.001 or more to 0.5 or less; and $n^{11}$ is an integer of 0 or more.

This siloxane compound is added to the conductive particles, followed by dispersion, or conductive metal oxide particles surface-treated with this siloxane compound is dispersed in a binder resin dissolved in a solvent, thereby preparing a protective-layer coating fluid free of secondary particles of dispersed particles and more stable in its dispertion over time. Also, the protective layer formed using such a coating fluid can have a high transparency, and a film having especially good environmental resistance can be obtained.

There are no particular limitations on the molecular weight of the siloxane compound having structure represented by the above Formula (1). However, when the conductive particles are surface-treated with it, it is better for the compound not to have too high a viscosity in view of the readiness of surface treatment. It may preferably have a weight-average molecular weight of from 100 to 50,000, and particularly preferably from 500 to 10,000 in view of the treatment efficiency of the surface treatment.

As methods for the surface treatment, there are two methods, a wet process and a dry process.

In the wet-process treatment, the conductive particles (conductive metal oxide particles) and the siloxane compound having structure represented by Formula (1) are dispersed in a solvent to make the siloxane compound adhere to the particle surfaces.

As a dispersion means, they may be dispersed by using a usual dispersion means such as a ball mill or a sand mill.

Next, this dispersion is made to fix to the conductive-particle surfaces by heat treatment. In this heat treatment, Si—H bonds in siloxane undergo oxidation of hydrogen atoms which is caused by the oxygen in air in the course of the heat treatment to form additional siloxane linkages. As the result, the siloxane comes to have a three-dimensional network structure, and the conductive-particle surfaces are covered with this network structure. Thus, the surface treatment is completed upon making the siloxane compound fix to the conductive-particle surfaces. The particles having been thus treated may optionally be subjected to pulverization treatment.

In the dry-process treatment, the siloxane compound and the conductive metal oxide particles are mixed without use of any solvent, followed by kneading to make the siloxane compound adhere to the particle surfaces. Thereafter, as in the case of the wet-process treatment, the resultant particles may be subjected to heat treatment and pulverization treatment to complete the surface treatment.

As the charge-transporting material usable in the protective layer of the electrophotographic photosensitive member according to the present invention, a compound having at least one hydroxyl group in the molecule is preferred. In particular, a compound having at least one hydroxyalkyl group, hydroxyalkoxyl group or hydroxyphenyl group in the molecule is preferred.

As a charge-transporting material having at least one of a hydroxyalkyl group and a hydroxyalkoxyl group in the molecule, a charge-transporting material having the structure represented by any of the following Formulas (2) to (4) is preferred.

(2)

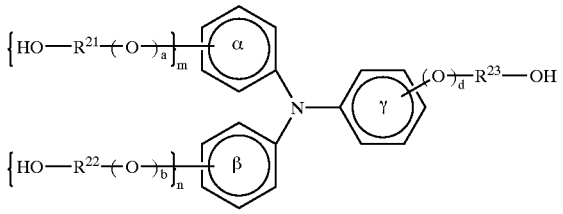

In Formula (2), $R^{21}$, $R^{22}$ and $R^{23}$ each independently represent a divalent hydrocarbon group having 1 to 8 carbon atoms and which may be branched. The benzene rings α, β and γ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols a, b, d, m and n each independently represent 0 or 1.

(3)

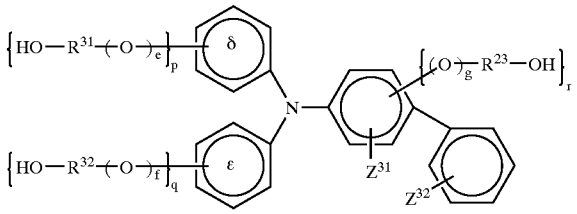

In Formula (3), $R^{31}$, $R^{32}$ and $R^{33}$ each independently represent a divalent hydrocarbon group having 1 to 8 carbon atoms and which may be branched. The benzene rings δ and ε may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols e, f and g each independently represent 0 or 1. Letter symbols p, q and r each independently represent 0 or 1, provided that a case in which all of them are simultaneously 0 is excluded. $Z^{31}$ and $Z^{32}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring.

(4)

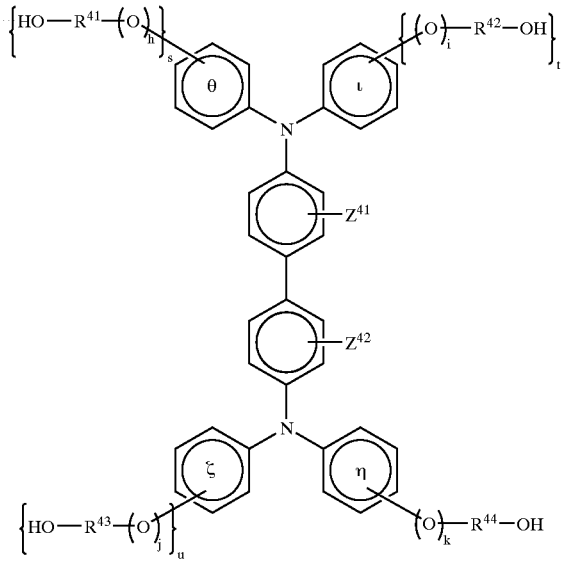

In Formula (4), $R^{41}$, $R^{42}$, $R^{43}$ and $R^{44}$ each independently represent a divalent hydrocarbon group having 1 to 8 carbon atoms and which may be branched. The benzene rings ζ, η, θ and ι may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. Letter symbols h, i, j, k, s, t and u each independently represent 0 or 1. $Z^{41}$ and $Z^{42}$ each independently represent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may combine to form a ring.

As a charge-transporting material having a hydroxyphenyl group in the molecule, a charge-transporting material having structure represented by any of the following Formulas (5) to (7) is preferred.

(5)

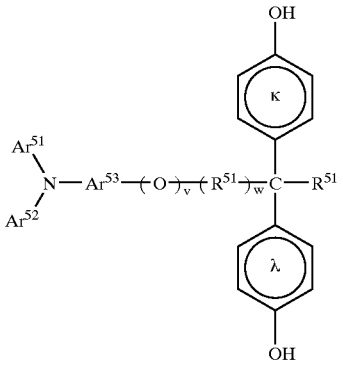

In Formula (5), $R^{51}$ represents a divalent hydrocarbon group having 1 to 8 carbon atoms and which may be branched. $R^{52}$ represents a hydrogen atom, a substituted or unsubstituted alkyl group, a substituted or unsubstituted aralkyl group or a substituted or unsubstituted phenyl group. $Ar^{51}$ and $Ar^{52}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group. $Ar^{53}$ represents a substituted or unsubstituted divalent aromatic hydrocarbon ring group or a substituted or unsubstituted divalent aromatic heterocyclic group. Letter symbols v and w each independently represent 0 or 1, provided that w is 0 when v is 0. The benzene rings κ and λ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group.

(6)

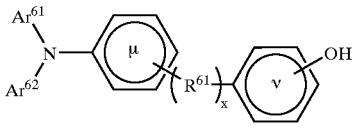

In Formula (6), $R^{61}$ represents a divalent hydrocarbon group having 1 to 8 carbon atoms and which may be branched. $Ar^{61}$ and $Ar^{62}$ each independently represent a substituted or unsubstituted alkyl group, a substituted or unsubstituted aralkyl group, a substituted or unsubstituted aromatic hydrocarbon ring group or a substituted or unsubstituted aromatic heterocyclic group. Letter symbol x represents 0 or 1. The benzene rings μ and ν may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or the benzene rings μ and ν may combine via a substituent to form a ring.

(7)

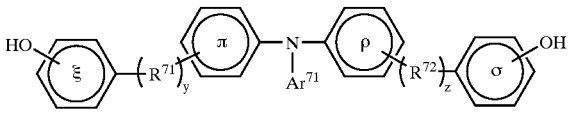

In Formula (7), $R^{71}$ and $R^{72}$ each independently represent a divalent hydrocarbon group having 1 to 8 carbon atoms and which may be branched. $Ar^{71}$ represents a substituted or unsubstituted alkyl group, a substituted or unsubstituted aralkyl group, a substituted or unsubstituted aromatic hydrocarbon ring group or a substituted or unsubstituted aromatic heterocyclic group. Letter symbols y and z each independently represent 0 or 1. The benzene rings ξ, π, ρ and σ may each independently have as a substituent a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group. The benzene rings ξ and π and the benzene rings ρ and σ may each independently combine via a substituent to form a ring.

In the above formulas (2) to (7), the divalent hydrocarbon groups represented by $R^{21}$, $R^{22}$, $R^{23}$, $R^{31}$, $R^{32}$, $R^{33}$, $R^{41}$, $R^{42}$, $R^{43}$, $R^{44}$, $R^{51}$, $R^{61}$, $R^{71}$ and $R^{72}$, having 1 to 8 carbon atoms and which may be branched, may include alkylene groups such as a methylene group, an ethylene group, a propylene group and a butylene group, an isopropylene group, and a cyclohexylidene group.

The alkyl group represented by $R^{52}$ may include a methyl group, an ethyl group, a propyl group and a butyl group; and the aralkyl group may include a benzyl group, a phenethyl group and a naphthylmethyl group.

Of the substituents the benzene rings α, β, γ, δ, ε, ζ, η, θ, ι, κ, λ, μ, ν, ξ, π, ρ and σ may have, the halogen atom may include a fluorine atom, a chlorine atom, a bromine atom and an iodine atom; the alkyl group may include a methyl group, an ethyl group, a propyl group and a butyl group; the alkoxyl group may include a methoxyl group, an ethoxyl group, a propoxyl group and a butoxyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

In the cases in which the benzene rings μ and ν, the benzene rings ξ and π and the benzene rings ρ and σ each combine via a substituent to form a ring, the substituent may include a propylidene group and an ethylene group. Via such groups, cyclic structures such as a fluorene skeleton and a dihydrophenanthrene skeleton are formed.

The halogen atoms represented by $Z^{31}$, $Z^{32}$, $Z^{41}$ and $Z^{42}$ may also include a fluorine atom, a chlorine atom, a bromine atom and an iodine atom; the alkyl group may include a methyl group, an ethyl group, a propyl group and a butyl group; the alkoxyl group may include a methoxyl group, an ethoxyl group, a propoxyl group and a butoxyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

The alkyl groups represented by $Ar^{51}$, $Ar^{52}$, $Ar^{61}$, $Ar^{62}$ and $Ar^{71}$ may also include a methyl group, an ethyl group, a propyl group and a butyl group; the aralkyl group may include a benzyl group, a phenethyl group and a naphthylmethyl group; the aromatic hydrocarbon ring group may include a phenyl group, a naphthyl group, an anthryl group and a pyrenyl group; and the aromatic heterocyclic group may include a pyridyl group, a thienyl group, a furyl group and a quinolyl group.

The divalent aromatic hydrocarbon ring group represented by $Ar^{53}$ may include a phenylene group, a naphthylene group, an anthrylene group and a pyrenylene group; and the divalent aromatic heterocyclic group may include a pyridilene group and a thienylene group.

The substituents the above groups may have may include alkyl groups such as a methyl group, an ethyl group, a propyl group and a butyl group; aralkyl groups such as a benzyl group, a phenethyl group and a naphthylmethyl group; aromatic hydrocarbon ring groups and aromatic heterocyclic groups such as a phenyl group, a naphthyl group, an anthryl group, a pyrenyl group, a fluorenyl group, a carbazolyl group, a dibenzofuryl group and a benzothiophenyl; alkoxyl groups such as a methoxyl group, an ethoxyl group and a propoxyl group; aryloxyl groups such as a phenoxyl group and a naphthoxyl group; halogen atoms such as a fluorine atom, a chlorine atom, a bromine atom and an iodine atom; and a nitro group and a cyano group.

The charge-transporting material having structure represented by any of the above Formulas (2) to (7) has a good compatibility with the phenolic resin, and films of protective layers in which it has uniformly been dispersed can be produced with ease.

In order to more improve the compatibility, the divalent hydrocarbon groups represented by $R^{21}$, $R^{22}$, $R^{23}$, $R^{31}$, $R^{32}$, $R^{33}$, $R^{41}$, $R^{42}$, $R^{43}$ and $R^{44}$ in the above Formulas (2) to (4) may preferably be those having 4 or less carbon atoms, and also the number of the hydroxylalkyl group and hydroxylalkoxyl group may preferably be two or more.

In the charge-transporting material having structure represented by any of the above Formulas (5) to (7), the hydroxyphenyl group contained therein reacts with the phenolic resin, and the charge-transporting material is incorporated in the matrix of the protective layer, so that the layer can have a higher strength as the protective layer.

The charge-transporting material having structure represented by any of the above Formulas (2) to (7) is uniformly dissolved or dispersed in a coating fluid for producing the protective layer, and the coating fluid is coated to form the protective layer.

The charge-transporting material having structure represented by any of the above Formulas (2) to (7) and the binder resin may preferably be mixed in a proportion of charge-transporting material/binder resin=0.1/10 to 20/10, and particularly preferably 0.5/10 to 10/10. If the charge-transporting material is in a too small quantity in respect to the binder resin, the effect of lowering the residual potential may be small. If it is in a too large quantity, the protective layer may have a low strength.

Examples of the charge-transporting material having structure represented by any of the above Formulas (2) to (7) are shown below. Note that the present invention is by no means limited to these.

| No. | Exemplary Compounds |
|---|---|
| 1 | 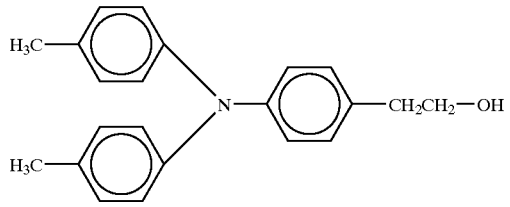 |
| 2 | 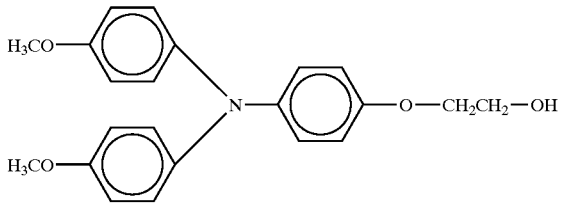 |
| 3 | 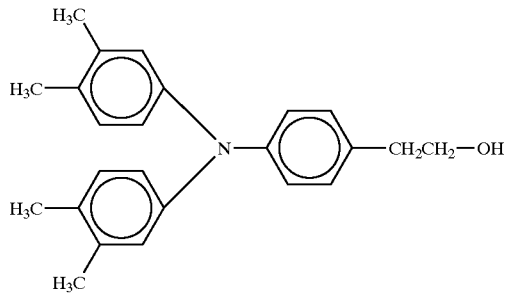 |

-continued
| No. | Exemplary Compounds |
|---|---|
| 4 | 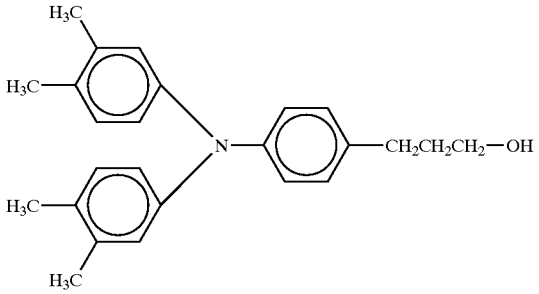 |
| 5 | 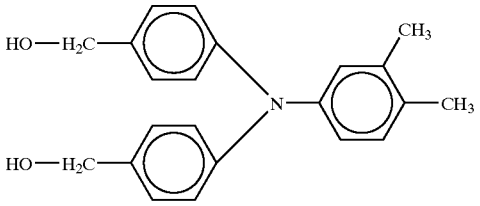 |
| 6 | 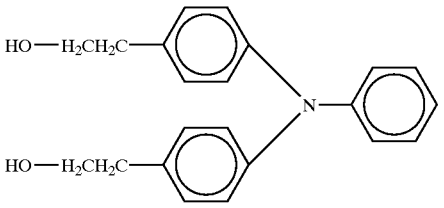 |
| 7 | 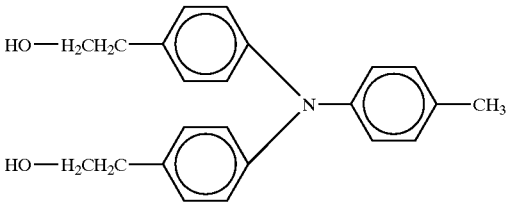 |
| 8 | 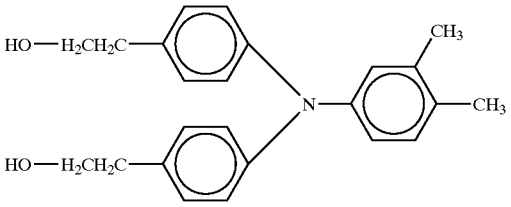 |
| 9 | 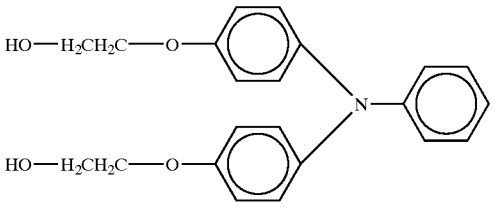 |

-continued
| No. | Exemplary Compounds |
|---|---|
| 10 | 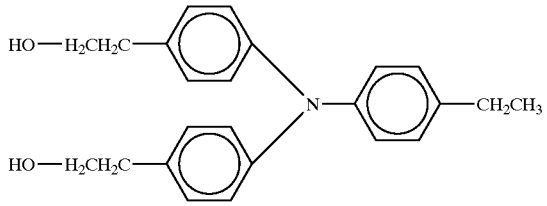 |
| 11 | 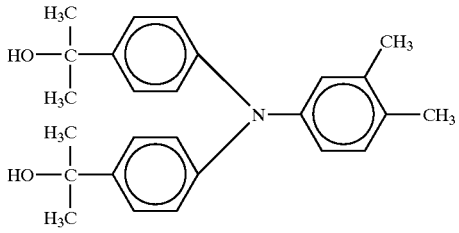 |
| 12 | 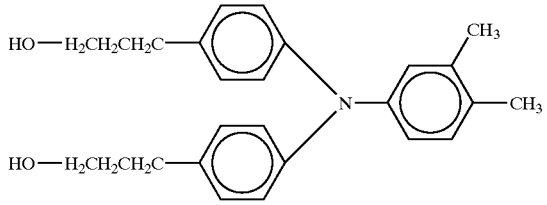 |
| 13 | 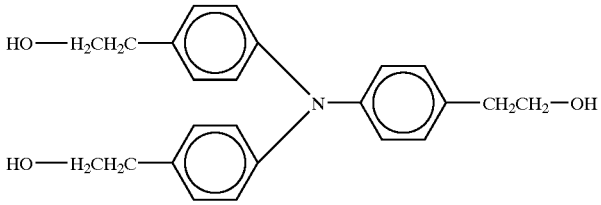 |
| 14 | 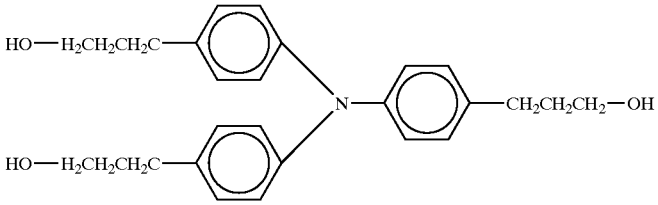 |
| 15 | 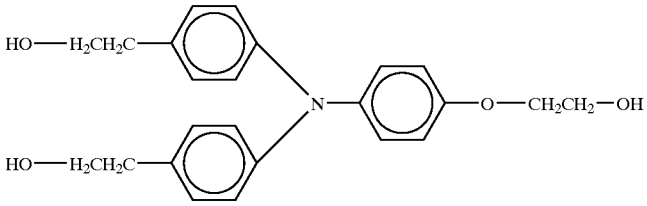 |
| 16 | 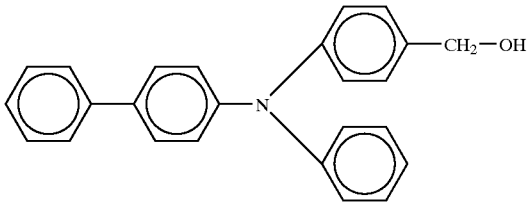 |

-continued
| No. | Exemplary Compounds |
|---|---|
| 17 | 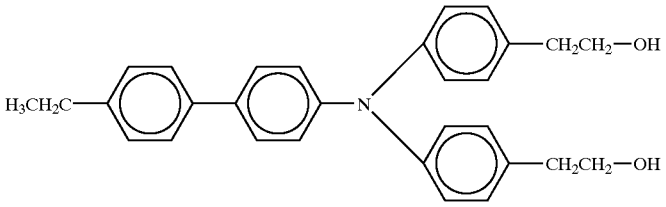 |
| 18 | 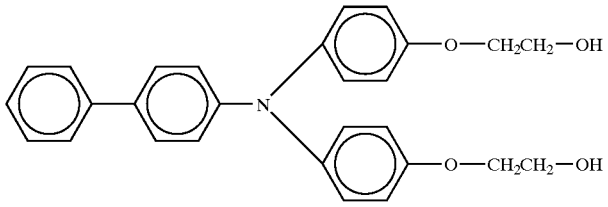 |
| 19 | 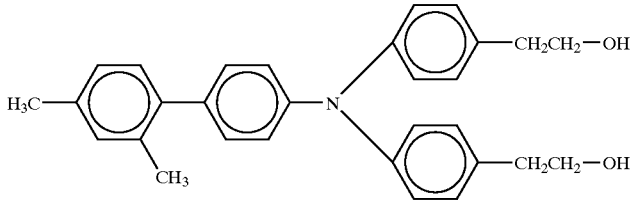 |
| 20 | 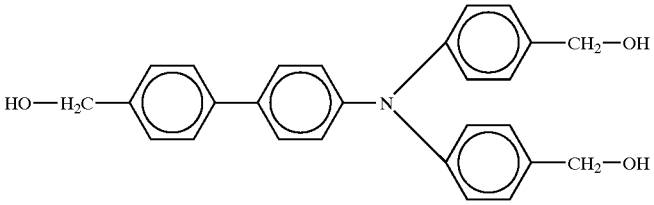 |
| 21 | 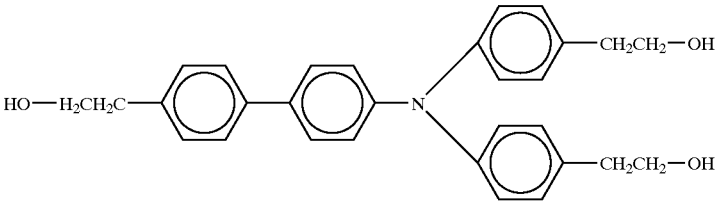 |
| 22 | 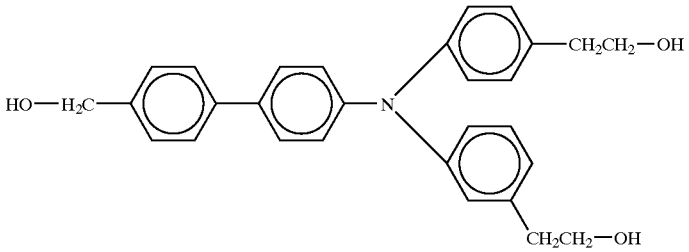 |
| 23 | 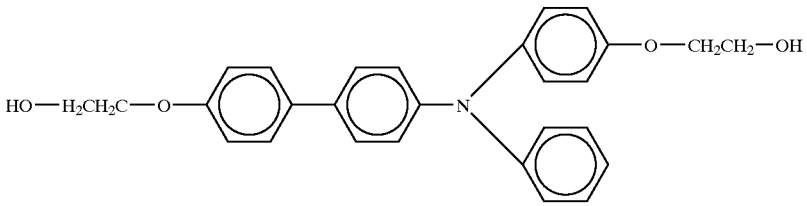 |

-continued
| No. | Exemplary Compounds |
|---|---|
| 24 | 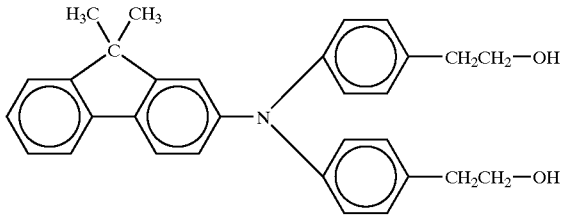 |
| 25 | 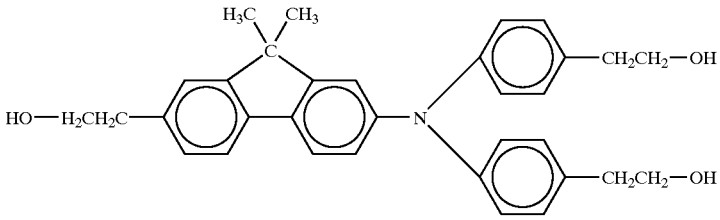 |
| 26 | 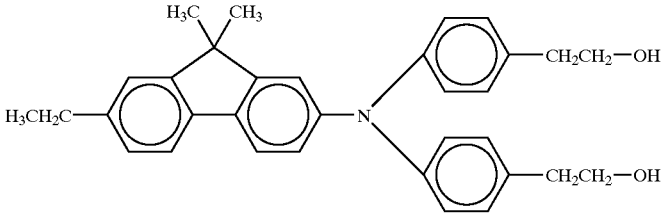 |
| 27 | 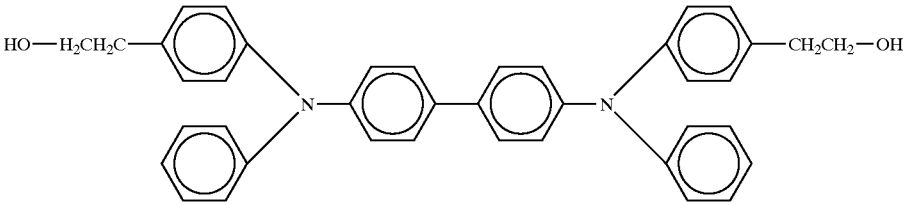 |
| 28 | 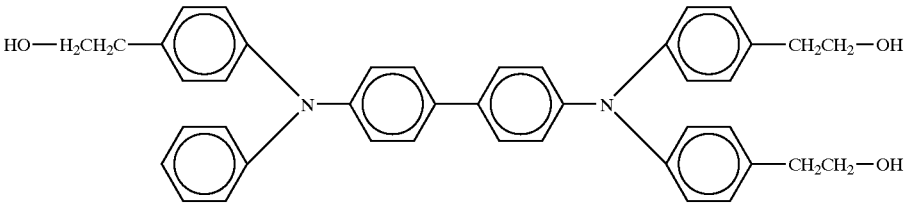 |
| 29 | 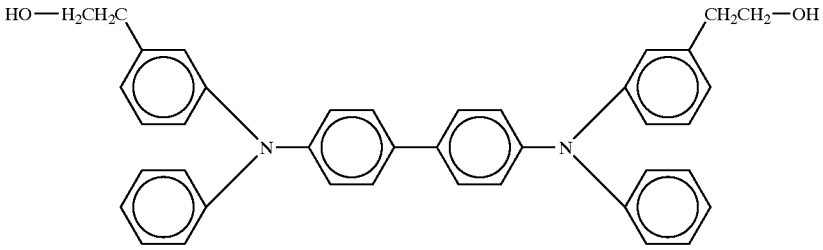 |
| 30 | 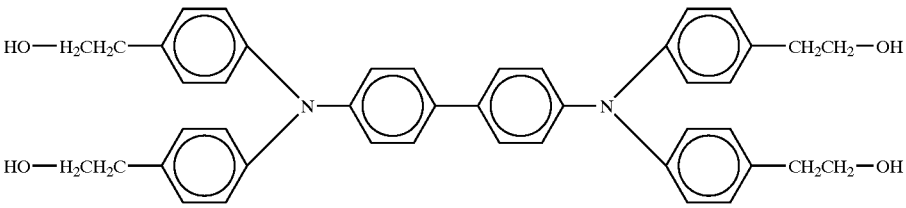 |

-continued
| No. | Exemplary Compounds |
|---|---|
| 31 | 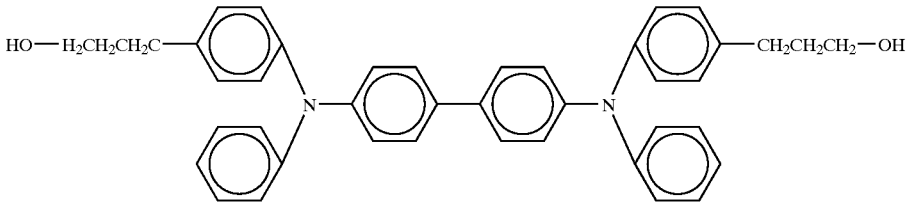 |
| 32 | 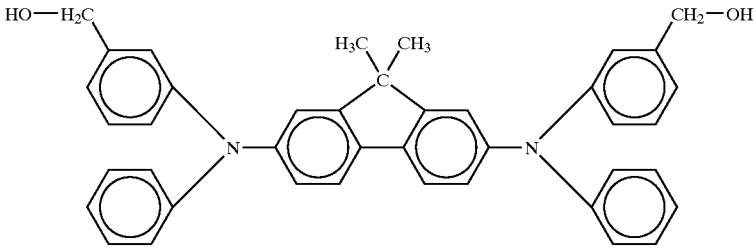 |
| 33 | 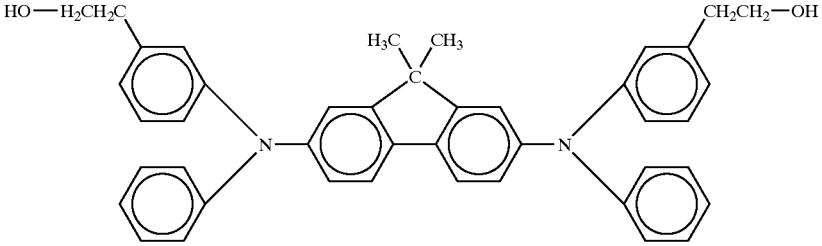 |
| 34 | 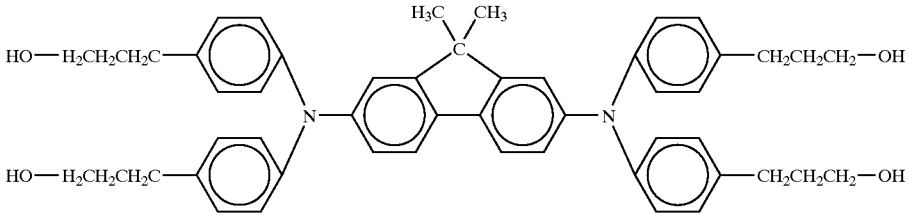 |
| 35 | 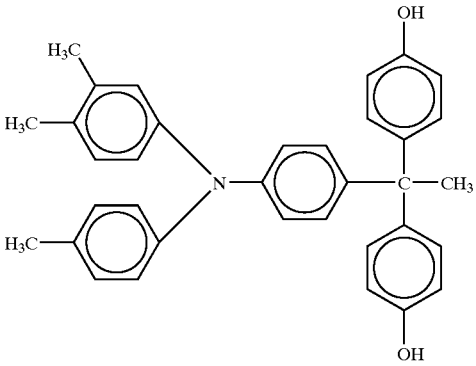 |

-continued
| No. | Exemplary Compounds |
|---|---|
| 36 | 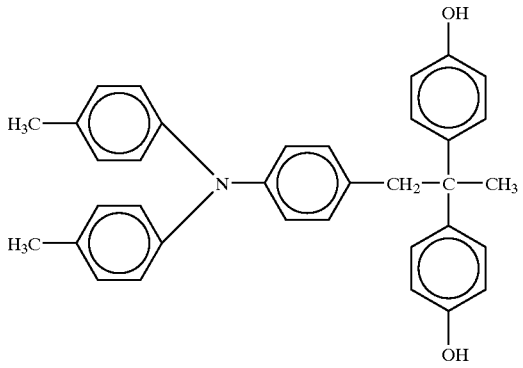 |
| 37 | 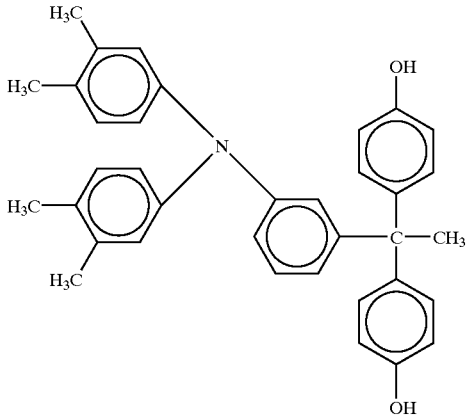 |
| 38 | 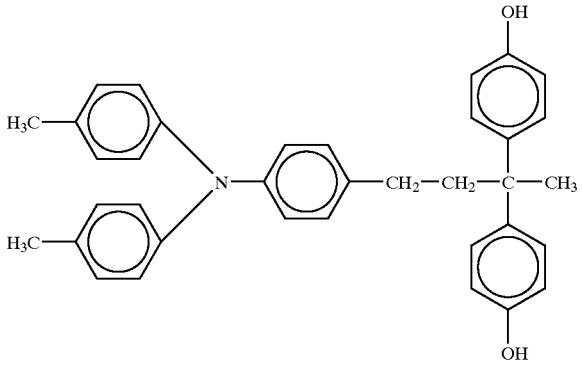 |
| 39 | 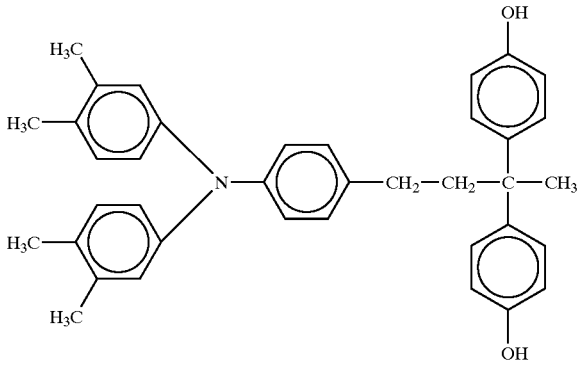 |

-continued
| No. | Exemplary Compounds |
|---|---|
| 40 | 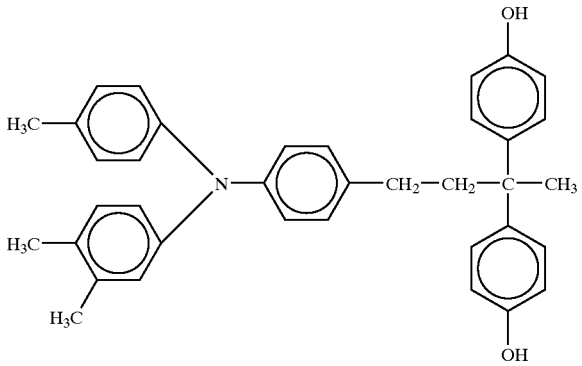 |
| 41 | 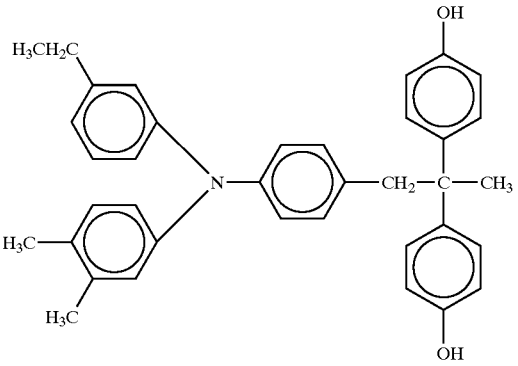 |
| 42 | 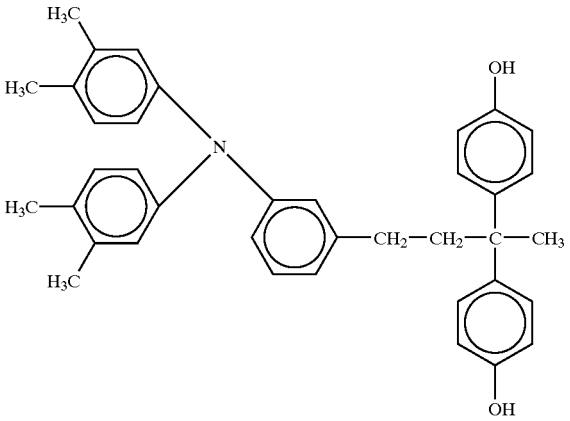 |
| 43 | 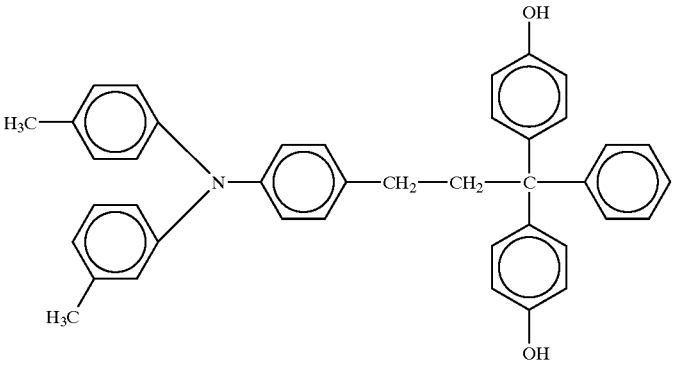 |

-continued
| No. | Exemplary Compounds |
|---|---|
| 44 | 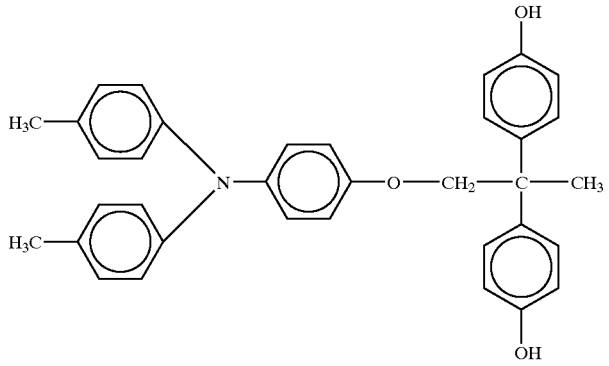 |
| 45 | 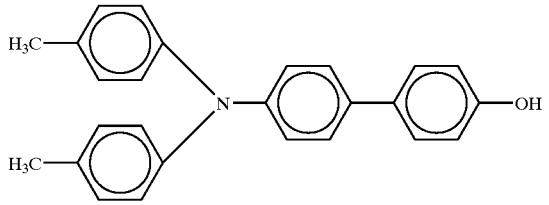 |
| 46 | 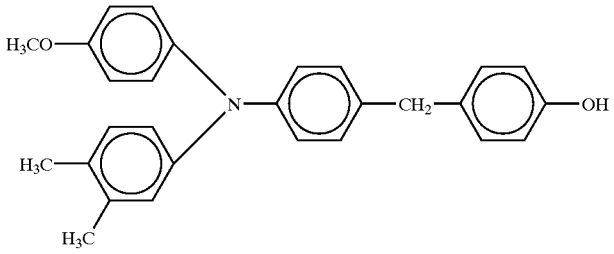 |
| 47 | 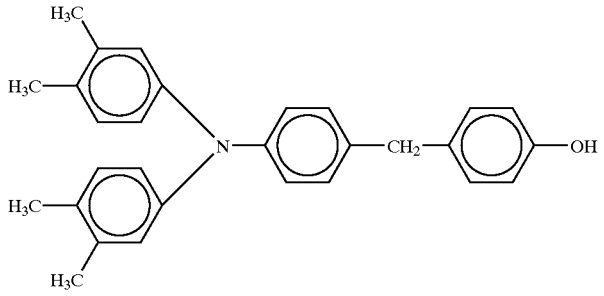 |
| 48 | 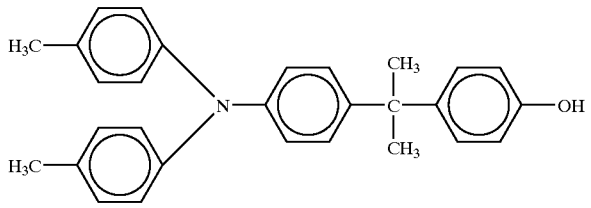 |

-continued
| No. | Exemplary Compounds |
|---|---|
| 49 | 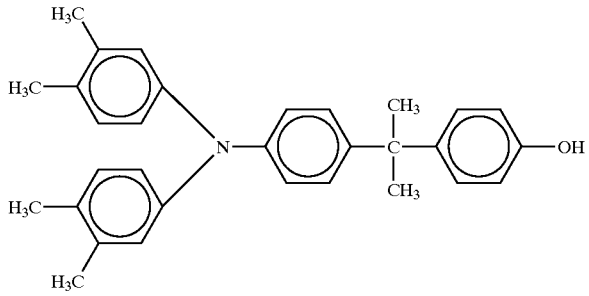 |
| 50 | 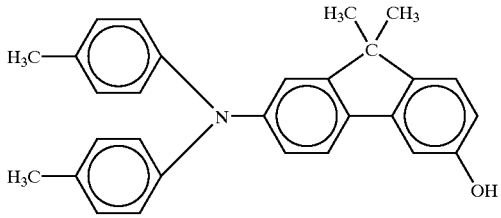 |
| 51 | 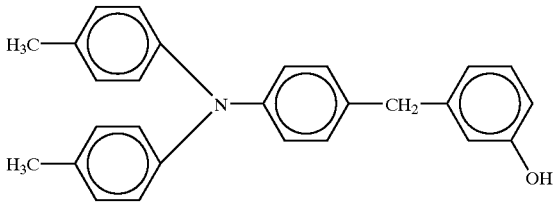 |
| 52 | 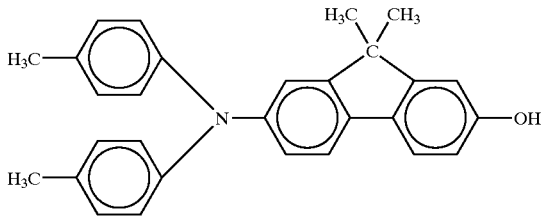 |
| 53 | 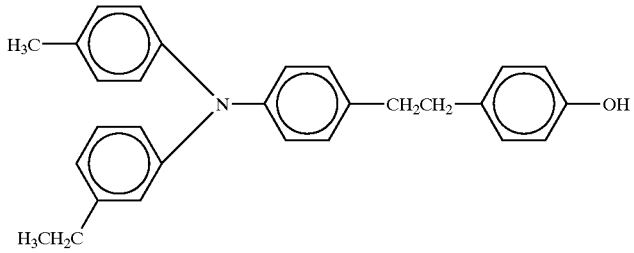 |
| 54 | 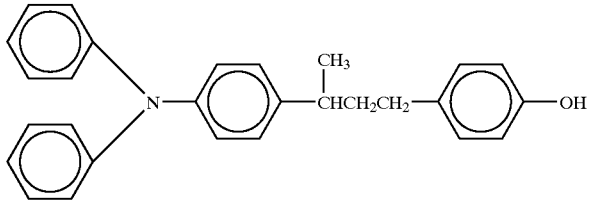 |

-continued
| No. | Exemplary Compounds |
|---|---|
| 55 | 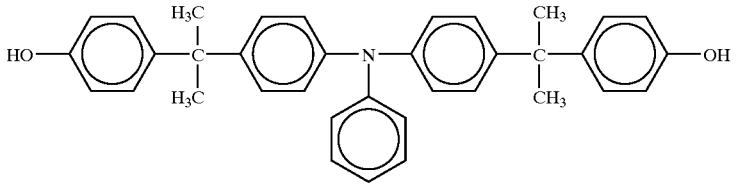 |
| 56 | 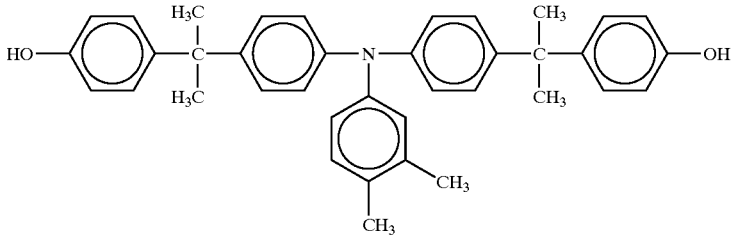 |
| 57 | 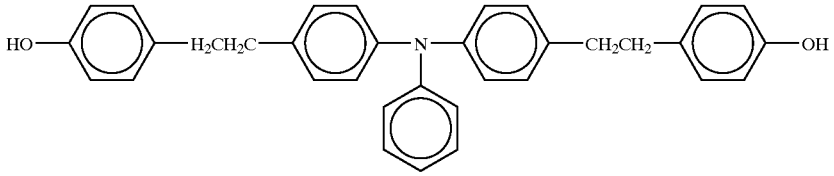 |
| 58 | 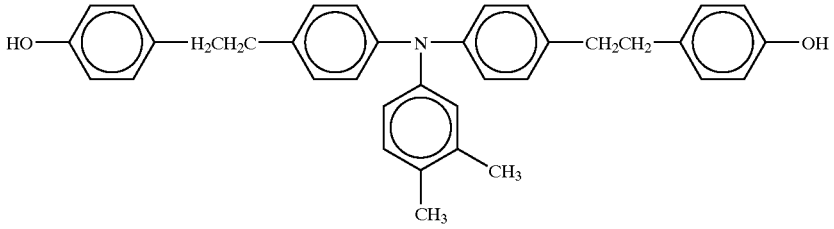 |
| 59 | 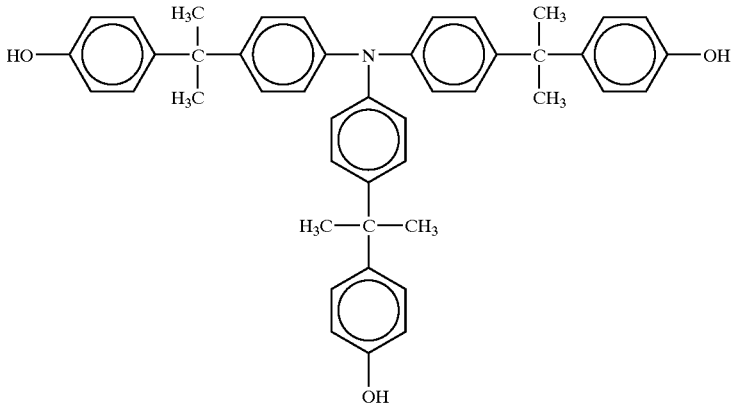 |
| 60 | 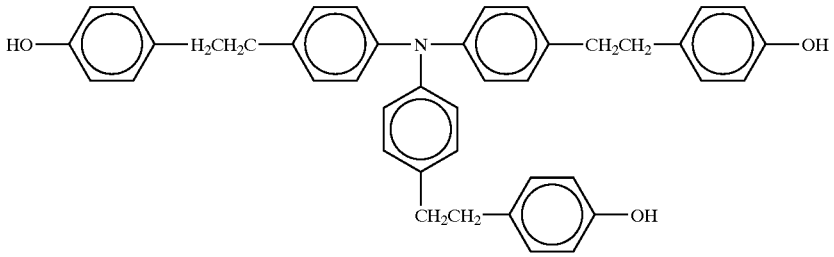 |

Of these, Exemplary Compounds (3), (4), (5), (8), (11), (12), (13), (17), (21), (24), (25), (26), (27), (28), (30), (31), (34), (35), (39), (44), (48), (49), (50), (52), (55), (56), (58) and (59) are preferred. Further, Exemplary Compounds (3), (8), (12), (25), (31), (39), (44), (49) and (56) are more preferred.

As the solvent in which the components for the protective layer coating fluid are to be dissolved or dispersed, a solvent is preferable which sufficiently dissolves the binder resin, sufficiently dissolves the charge-transporting material having structure represented by any of the above Formulas (2) to (7), affords good dispersibility for the conductive particles where such particles are used, has good compatibility with and good treating performance for the lubricating particles such as the fluorine-atom-containing compound, the fluorine-atom-containing resin particles and the siloxane compound where such particles are used, and does not adversely affect the charge transport layer with which the coating fluid for the protective layer is to come into contact.

Accordingly, usable as the solvent are alcohols such as methanol, ethanol and 2-propanol, ketones such as acetone and methyl ethyl ketone, esters such as methyl acetate and ethyl acetate, ethers such as tetrahydrofuran and dioxane, aromatic hydrocarbons such as toluene and xylene, and halogen type hydrocarbons such as chlorobenzene and dichloromethane, any of which may further be used in the form of a mixture. Of these, solvents most preferable for the phenolic resin are alcohols such as methanol, ethanol and 2-propanol.

Conventional charge-transporting materials are commonly insoluble or slightly soluble in alcohol type solvents, and are difficult to uniformly disperse in common phenolic resins. However, many of the charge-transporting materials used in the present invention are soluble in solvents composed chiefly of alcohols, and hence can be dispersed in the solvent in which the phenolic resin is dissolved.

The protective layer in the present invention may be formed by applying a solution containing the aforementioned compound onto the photosensitive member and drying it. The contained binder resin is preferably a curable resin, and when the curable resin is a thermosetting resin, its setting temperature is preferably 100° C. to 300° C., and in particular, 120° C. to 200° C.

In addition, the thickness of the protective layer is preferably 1 to 5.5 $\mu$m from the charge movement viewpoint.

Coating methods usable for forming the protective layer include a dipping coating method, a splay coating method, a spinner coating method, a roller coating method, a Meyer bar coating method, a blade coating method, etc.

In the present invention, additives such as an antioxidant may be incorporated in the protective layer in order to prevent the surface layer from deteriorating because of adhesion of active substances such as ozone and nitrogen oxides generated at the time of charging.

The photosensitive layer of the electrophotographic photosensitive member of the present invention will be described below.

The photosensitive layer in the present invention may be either of a single layer type in which a charge-generating compound and a charge-transporting compound is contained in a single layer or of a layered (or multi-layer) type which has a charge generation layer containing a charge-generating compound and a charge transport layer containing a charge-transporting compound, but preferably is the layered type in which the charge generation layer and the charge transport layer are superposed successively on a conductive substrate. Examples of this type are shown in FIGS. 1A, 1B and 1C.

Figure 1B:
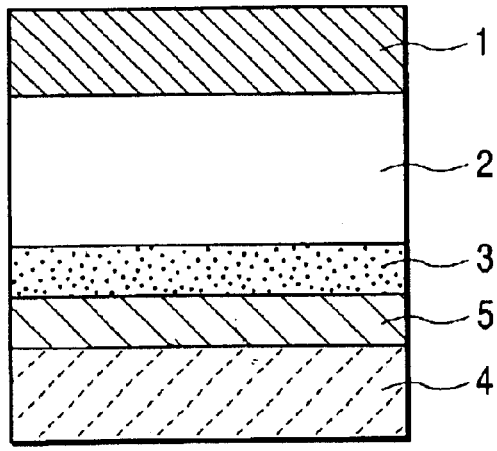
Figure 1C:
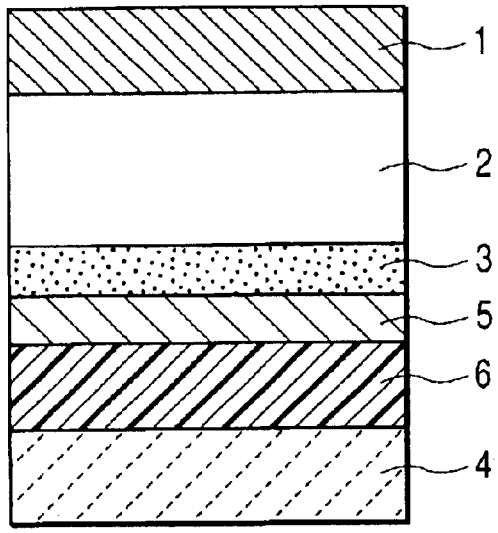

The electrophotographic photosensitive member shown in FIG. 1A comprises a conductive support 4 and a charge generation layer 3 and a charge transport layer 2 in this order provided thereon, and a protective layer 1 further provided as the surface layer.

As the conductive support 4, it may be a support having conductivity in itself, as exemplified by supports made of a metal such as aluminum, aluminum alloy or stainless steel. Besides these, also usable are plastic supports on which aluminum, aluminum alloy, indium oxide-tin oxide alloy or the like has been formed in film form by vacuum deposition, supports comprising plastic or paper impregnated with conductive particles (e.g., carbon black, tin oxide, titanium oxide or silver particles) together with a suitable binder resin, and plastics having a conductive binder.

As the shape of the conductive support 4, it may be, e.g., of a cylindrical-drum type or in the shape of a belt, and there are no particular limitations.

In the present invention, a binding layer (adhesion layer) 5 having a function as a barrier and a function of adhesion may be provided between the conductive support 4 and the photosensitive layer (FIG. 1B).

The binding layer 5 is formed for the purposes of, e.g., improving the adhesion of the photosensitive layer, improving coating performance, protecting the support, covering any defects of the support, improving the injection of electric charges from the support and protecting the photosensitive layer from any electrical breakdown. The binding layer 5, may be formed of, e.g., casein, polyvinyl alcohol, ethyl cellulose, an ethylene-acrylic acid copolymer, polyamide, modified polyamide, polyurethane, gelatin or aluminum oxide. The binding layer 5 may preferably have a layer thickness of 5 $\mu$m or less, and more preferably from 0.1 $\mu$m to 3 $\mu$m.

In the present invention, as shown in FIG. 1C, the binding layer 5 and also a subbing layer 6 aiming at prevention of interference fringes may further be provided between the conductive support 4 and the charge generation layer 3.

The charge generation layer 3 contains a charge-generating material and optionally a binder resin.

The charge-generating material may include azo pigments such as monoazo, disazo and trisazo; phthalocyanine pigments such as metal phthalocyanines and metal-free phthalocyanine; indigo pigments such as indigo and thioindigo; perylene pigments such as perylene acid anhydrides and perylene acid imides; polycyclic quinone pigments such as anthraquinone and pyrenequinone; squarilium dyes; salts such as pyrylium salts and thiapyrylium salts; triphenylmethane dyes; inorganic materials such as selenium, selenium-tellurium and amorphous silicon; quinacridone pigments; azulenium salt pigments; cyanine dyes; xanthene, dyes; quinoneimine dyes; styryl dyes; cadmium sulfide; and zinc oxide. Of these, in the present invention, gallium phthalocyanine compounds are preferable, and in particular, hydroxygallium phthalocyanine is preferable, which preferably has intense peaks at 7.5° and 28.2° of the Bragg angle (2θ±0.2°) in the $CuK_\alpha$ characteristic X-ray diffraction.

The binder resin may include polycarbonate resins, polyester resins, polyarylate resins, butyral resins, polystyrene resins, polyvinyl acetal resins, diallyl phthalate resins, acrylic resins, methacrylic resins, vinyl acetate resins, phenolic resins, silicone resins, polysulfone resins, styrene-butadiene copolymer resins, alkyd resins, epoxy resins, urea resins, and vinyl chloride-vinyl acetate copolymer resins. Examples are by no means limited to these. Any of these may be used alone or in the form of a mixture or copolymer of two or more types.

In the formation of the charge generation layer 3, the charge-generating material may sufficiently be dispersed in a solvent and the binder resin, which is used in a weight ratio of about 0.3 to 4 times, by means of a homogenizer, an ultrasonic dispersion machine, a ball mill, a sand mill, an attritor or a roll mill, and the resultant dispersion is coated, followed by drying. It may preferably be formed in a layer thickness of 5 $\mu$m or less, and particularly from 0.01 $\mu$m to 1 $\mu$m.

As the solvent used therefor, it may be selected taking into account the solubility or dispersion stability of the charge-generating material or binder resin to be used. As an organic solvent, usable are alcohols, sulfoxides, ketones, ethers, esters, aliphatic halogenated hydrocarbons or aromatic compounds.

To the charge generation layer 3, a sensitizer, an antioxidant, an ultraviolet absorber, a plasticizer and so forth which may be of various types may also optionally be added.

The charge transport layer 2 contains a charge-transporting material and optionally a binder resin.

The charge-transporting material may include various triarylamine compounds, various hydrazone compounds, various styryl compounds, various stilbene compounds, various pyrazoline compounds, various oxazole compounds, various thiazole compounds, and various triarylmethane compounds.

The binder resin which may be used to form the charge transport layer may include acrylic resins, styrene resins, polyester resins, polycarbonate resins, polyarylate resins, polysulfone resins, polyphenylene oxide resins, epoxy resins, polyurethane resins, alkyd resins and unsaturated resins. Of these, polymethyl methacrylate, polystyrene, a styrene-acrylonitrile copolymer, polycarbonate resins and diallyl phthalate resins are particularly preferred.

The charge transport layer 2 may be formed by applying a solution prepared by dissolving the above charge-transporting material and binder resin in a solvent, followed by drying. The charge-transporting material and the binder resin may be mixed in a proportion of from about 2:1 to 1:2 in weight ratio.

As the solvent, it may include ketones such as acetone and methyl ethyl ketone, esters such as methyl acetate and ethyl acetate, aromatic hydrocarbons such as toluene and xylene, and chlorine type hydrocarbons such as chlorobenzene, chloroform and carbon tetrachloride.

When this charge transport layer coating solution is applied, coating methods as exemplified by dip coating, spray coating and spinner coating may be used.

The drying may preferably be carried out at a temperature of from 10° C. to 200° C., and particularly preferably from 20° C. to 150° C., and for a time of from 5 minutes to 5 hours, and particularly preferably from 10 minutes to 2 hours.

In addition, the charge transport layer is connected electrically with the charge generation layer, and has a function of transporting, under an electrical field, charges injected from the charge generation layer to the interface with the protective layer. Accordingly, the thickness of the charge transport layer should not be thicker than needed, and hence, is preferably 5 to 40 $\mu$m, particularly 7 to 30 $\mu$m.

To the charge transport layer 2, an antioxidant, an ultraviolet absorber, a plasticizer and so forth may further optionally be added.

In the present invention, the protective layer 1 is further formed on this charge transport layer 2 by the method described previously.

Specific embodiments of an electrophotographic apparatus making use of the electrophotographic photosensitive member of the present invention are shown below.

Embodiment 1

Figure 2:
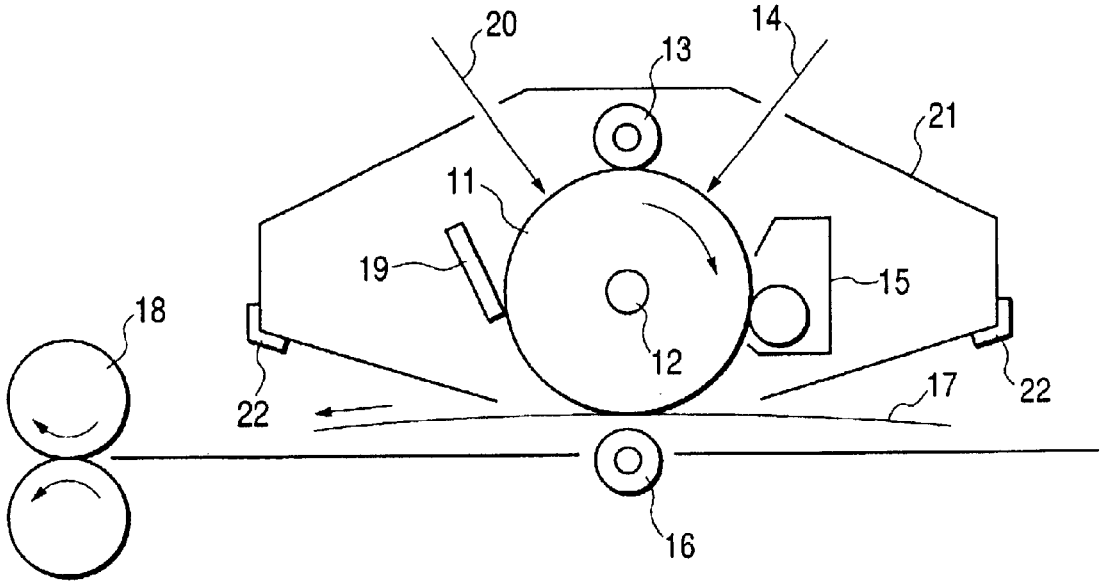
FIG. 2 is a schematic view showing the construction of Embodiment 1 which is an electrophotographic apparatus provided with a process cartridge having the electrophotographic photosensitive member according to the present invention.

FIG. 2 schematically illustrates the construction of an electrophotographic apparatus provided with a process cartridge having the electrophotographic photosensitive member of the present invention.

In FIG. 2, reference numeral 11 denotes a drum-shaped electrophotographic photosensitive member of the present invention, which is rotatively driven around an axis 12 in the direction of an arrow at a stated peripheral speed.

The electrophotographic photosensitive member 11 is, in the course of its rotation, uniformly electrostatically charged on its periphery to a positive or negative, given potential through a (primary) charging means 13. The electrophotographic photosensitive member thus charged is then exposed to exposure light 14 emitted from an exposure means (not shown) for slit exposure or laser beam scanning exposure and intensity-modulated correspondingly to time-sequential digital image signals of the intended image information. In this way, electrostatic latent images corresponding to the intended image information are successively formed on the periphery of the electrophotographic photosensitive member 11.

The electrostatic latent images thus formed are subsequently developed with toner by the operation of a developing means 15. The toner images thus formed and held on the surface of the electrophotographic photosensitive member 11 are then successively transferred by the operation of a transfer means 16, to a transfer material 17 fed from a paper feed section (not shown) to the part between the electrophotographic photosensitive member 11 and the transfer means 16 in the manner synchronized with the rotation of the electrophotographic photosensitive member 11.

The transfer material 17 on which the toner images have been transferred is separated from the surface of the electrophotographic photosensitive member, is led to an image fixing means 18, where the toner images are fixed, and is then printed out of the apparatus as an image-formed material (a print or copy).

The surface of the electrophotographic photosensitive member 11 from which images have been transferred is brought to removal of the toner remaining after the transfer, through a cleaning means 19. Thus, its surface is cleaned. Such transfer residual toner may also directly be collected through the developing means without providing any cleaning means (cleanerless). The electrophotographic photosensitive member is further subjected to charge elimination by pre-exposure light 20 emitted from a pre-exposure means (not shown), and then repeatedly used for the formation of images. Where the primary charging means 13 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 11, charging means 13, developing means 15 and cleaning means 19 so that the process cartridge is detachably mountable to the main body of an electrophotographic apparatus such as a copying machine or a laser beam printer. For example, at least one of the primary charging means 13, the developing means 15 and the cleaning means 19 may integrally be supported in a cartridge together with the electrophotographic photosensitive member 11 to form a process cartridge 21 that is detachably mountable on the main body of the apparatus through a guide means 22 such as rails provided in the main body of the apparatus.

In the case when the electrophotographic apparatus is a copying machine or a printer, the exposure light 14 is light reflected from, or transmitted through, an original, or light irradiated by the scanning of a laser beam, the driving of an LED array or the driving of a liquid-crystal shutter array according to signals obtained by reading an original through a sensor and converting the information into signals. Any other auxiliary process may also optionally be added.

Embodiment 2

Figure 3:
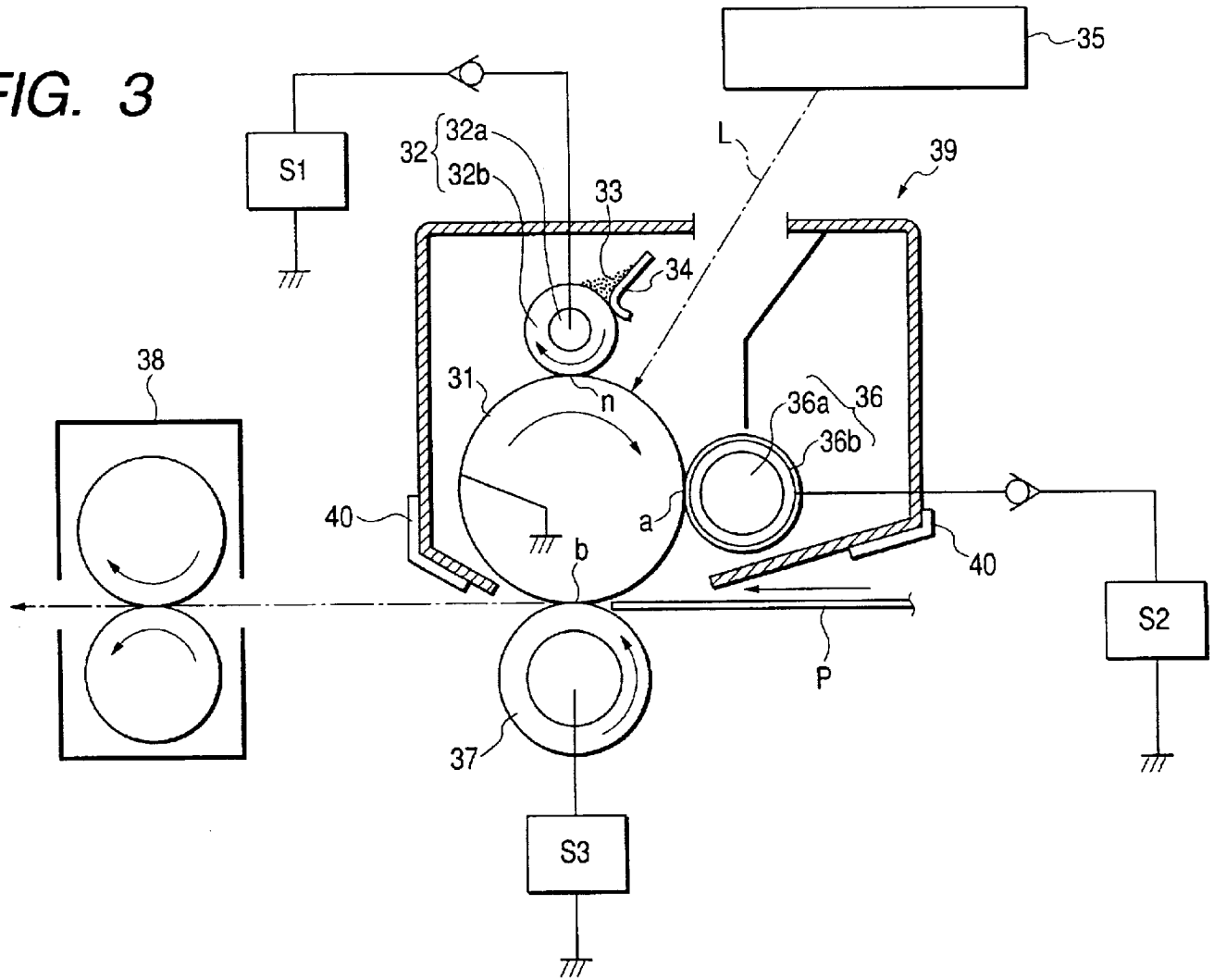
FIG. 3 is a schematic view showing the construction of Embodiment 2 which is another electrophotographic apparatus provided with a process cartridge having the electrophotographic photosensitive member according to the present invention.

FIG. 3 schematically illustrates the construction of an electrophotographic apparatus provided with a process cartridge having a means for feeding charging particles and having the electrophotographic photosensitive member of the present invention.

A drum-shaped electrophotographic photosensitive member 31 is rotatively driven in the direction of an arrow at a constant peripheral speed.

A charging roller 32 a charging means has is constituted of charging particles 33 (conductive particles for charging the electrophotographic photosensitive member electrostatically), and a medium-resistance layer (elastic layer) 32*b* and a mandrel 32*a* which constitute a charging-particle-holding member. The charging roller 32 is in contact with the electrophotographic photosensitive member 31 in a preset elastic deformation level to form a contact zone n.

The charging roller 32 in this embodiment is constituted of the mandrel 32*a* and formed thereon the medium-resistance layer 32*b* comprised of a rubber or a foam, and further held on its surface the charging particles 33.

The medium-resistance layer 32*b* is comprised of a resin (e.g., urethane), conductive particles (e.g., carbon black), a vulcanizing agent and a blowing agent or the like, and is formed into a roller on the mandrel 32*a*. Thereafter, its surface is polished.

The charging roller in this embodiment differs from the charging roller (charging roller for discharging) in Embodiment 1 especially in the following points.

(1) Surface structure and roughness characteristics so designed as to hold the charging particles on its surface in a high density.

(2) Resistance characteristics (volume resistivity, surface resistance) necessary for injection charging.

The charging roller for discharging has a flat surface, and has a surface average roughness Ra of submicrons or less and also a high roller hardness. In the charging which utilizes discharging, a phenomenon of discharge takes place at the gap of tens of micrometers ($\mu$m) which is a little apart from the contact zone between the charging roller and the electrophotographic photosensitive member. Where the charging roller and electrophotographic photosensitive member surfaces have unevenness, the phenomenon of discharge may become unstable because of electric field intensities which differ at some parts, to cause charge non-uniformity. Hence, the charging roller for discharging requires a flat and highly hard surface.

The reason why the charging roller for discharging can not perform injection charging is that, although the charging roller having such a surface structure as stated above externally appears to be in close contact with the drum (electrophotographic photosensitive member), the two are in almost non-contact with each other in respect of microscopic contact performance at a molecular level which is necessary for charge injection.

On the other hand, the charging roller 32 for injection charging is required to have a certain roughness because it is necessary to hold thereon the charging particles 33 in a high density. It may preferably have an average surface roughness Ra of from 1 $\mu$m to 500 $\mu$m. If it has the Ra of less than 1 $\mu$m, it may have an insufficient surface area for holding thereon the charging particles 33, and also, where any insulator (e.g., the toner) has adhered to the roller surface layer, it is difficult that at its surrounding area the charging roller 32 can come into contact with the electrophotographic photosensitive member 31, tending to lower its charging performance. If on the other hand it has the Ra of more than 500 $\mu$m, the unevenness of the charging roller surface tends to lower the in-plane charge uniformity of the electrophotographic photosensitive member.

The average surface roughness Ra is measured with a surface profile analyzer microscope VF-7500 or VF-7510, manufactured by Keyence Co. Using objective lenses of 1,250 magnifications to 2,500 magnifications, the roller surface profile and Ra can be measured in non-contact.

The charging roller for discharging comprises a mandrel on which a low-resistance base layer is formed and thereafter its surface is covered with a high-resistance layer. In the roller charging effected by discharging, applied voltage is so high that, if there are any pinholes (at which the support stands uncovered because of the damage of the film), the drop of voltage may extend up to their surrounding areas to cause faulty charging. Accordingly, the charging roller may preferably be made to have a surface resistance of $10^{11}$ Ω□ or more.

On the other hand, in the injection charging system, it is unnecessary to make the surface layer have a high resistance in order to make it possible to perform charging at a low voltage, and the charging roller may be constituted of a single layer. In the injection charging, the charging roller may preferably have a surface resistivity of from $10^4$ to $10^{10}$ Ω□. If it has a surface resistivity of more than $10^{10}$ Ω□, the in-plane charge uniformity may lower, and any non-uniformity due to the rubbing friction of the charging roller may appear as lines (or streaks) in halftone images, and a lowering of image quality level tends to be seen. If on the other hand it has a surface resistivity of less than $10^4$ Ω□, pinholes of the electrophotographic photosensitive member tend to cause the drop of voltage even in the injection charging.

The charging roller may further preferably have a volume resistivity ranging from $10^4$ to $10^7$ Ω·cm. If it has a volume resistivity of less than $10^4$ Ω·cm, the drop of voltage tends to occur because of a leakage of electric current through pinholes. If on the other hand it has a volume resistivity of more than $10^7$ Ω·cm, any electric current necessary for the charging may be difficult to ensure, tending to cause a lowering of charging voltage.

The resistivities of the charging roller are measured in the following way.

To measure roller resistivities, an insulator drum of 30 mm in outer diameter is provided with electrodes in such a way that a load of 1 kg in total pressure is applied to the mandrel 32*a* of the charging roller 32. As the electrodes, a guard electrode is disposed around a main electrode to make measurement. The distance between the main electrode and the guard electrode is adjusted substantially to the thickness of the elastic layer 32*b* so that the main electrode may ensure a sufficient width in respect to the guard electrode. In the measurement, a voltage of +100 V is applied from a power source to the main electrode, and electric currents flowing to ammeters Av and As are measured, and the volume resistivity and the surface resistivity, respectively, are measured.

In the injection charging system, it is important for the charging roller 32 to function as a flexible electrode. In the case of a magnetic brush, that is materialized in virtue of the flexibility a magnetic-particle layer itself has. In this embodiment, it is achieved by controlling the elastic properties of the medium-resistance layer (elastic layer) 32*b*. This layer may have an Asker-C hardness of from 15 degrees to 50 degrees as a preferable range, and from 25 degrees to 40 degrees as a more preferable range. If this layer has a too high hardness, any necessary elastic deformation level can not be attained, and the contact zone n can not be ensured between the charging roller and the electrophotographic photosensitive member, resulting in a lowering of charging performance. Also, the contact performance at a molecular level of substance can not be attained, and hence any inclusion of foreign matter may obstruct the contact at its surrounding area. If on the other hand this layer has a too low hardness, the shape of the roller may become unstable to make non-uniform a contact pressure with the charging object (electrophotographic photosensitive member) to cause charge non-uniformity. Otherwise, such a layer may cause faulty charging due to compression set of the roller when left standing for a long time.

Materials for the charging roller 32 may include ethylene-propylene-diene-methylene rubber (EPDM), urethane rubber, nitrile-butadiene rubber (NBR) and silicone rubber, and rubber materials such as isoprene rubber (IR) in which a conductive substance such as carbon black or a metal oxide has been dispersed for the purpose of resistance control. Without dispersing any conductive substance, it is also possible to make resistance control by using an ion-conductive material. Thereafter, if necessary, the surface roughness may be adjusted, or shaping may be made by polishing or the like. Also, a plurality of functionally separated layers may make up the elastic layer.

As a form of the roller, a porous-member structure is preferable. This is advantageous in view of manufacture in that the above surface roughness is achievable at the same time the roller is formed by molding. It is suitable for the porous member to have a cell diameter of from 1 $\mu$m to 500 $\mu$m. After the porous member has been formed by foam molding, its surface may be abraded to make the porous surface exposed, to produce a surface structure having the above roughness.

The charging roller 32 is provided in a stated elastic deformation level in respect to the electrophotographic photosensitive member 31 to form the contact zone n. At this contact zone n, the charging roller, which is rotatively driven in the direction opposite (counter) to the rotational direction of the electrophotographic photosensitive member 31, can come into contact with the electrophotographic photosensitive member 31 in the state the former has a velocity difference in respect to the latter's surface movement. Also, at the time of image recording of a printer, a stated charging bias is applied to the charging roller 32 from a charging bias application power source S1. Thus, the periphery of the electrophotographic photosensitive member 31 is uniformly electrostatically charged to a stated polarity and potential by the injection charging system.

The charging particles 33 are added to the toner and held in a developing assembly, and they are fed to the charging roller 32 via the electrophotographic photosensitive member 31 in conjunction with development with the toner. As a feeding means therefor, construction is employed in which a control blade 34 is brought into contact with the charging roller 32 and the charging particles 33 are held between the charging roller 32 and the control blade 34. The charging particles 33 are coated in a constant quantity on the charging roller 32 as the electrophotographic photosensitive member 31 is rotated, and reach the contact zone n between the charging roller 32 and the electrophotographic photosensitive member 31.

The charging particles 33 may also preferably have a particle diameter of 10 $\mu$m or less in order to ensure high charging efficiency and charging uniformity. In the present invention, the particle diameter in a case in which the charging particles constitute agglomerates is defined as an average particle diameter of the agglomerates. To measure the particle diameter, at least 100 particles are picked up through observation with an electron microscope, where the volume particle size distribution is calculated on the basis of horizontal-direction maximum chordal length, and the particle diameter is determined on the basis of the 50% average particle diameter.

The charging particles 33 may be present not only in the state of primary particles, but also in the state of agglomerated secondary particles without any problem at all. Whatever the agglomeration state is, their forms are not important as long as the agglomerates can function as the charging particles.

The charging particles 33 may preferably be white or closely transparent so that they do not especially obstruct latent-image exposure when used in the charging of the electrophotographic photosensitive member. They may further preferably be colorless or white when used in color image recording, taking into account the fact that the charging particles may partly inevitably be transferred to the transfer material P from the surface of the electrophotographic photosensitive member 31. Also, in order to prevent light scattering from being caused by the charging particles 33 at the time of imagewise exposure, they may preferably have a particle diameter which is not larger than the size of component image pixels, and more preferably not larger than the particle diameter of the toner. The lower limit of the particle diameter is considered to be 10 nm stably obtainable as particles.

Reference numeral 36 denotes a developing assembly. Electrostatic latent images formed on the surface of the electrophotographic photosensitive member 31 are developed as toner images by means of this developing assembly 36 at a developing zone a. In the developing assembly 36, a blended agent of a toner and charging particles added thereto is provided.

The electrophotographic apparatus (printer) in this embodiment carries out a toner recycle process. The transfer residual toner having remained on the surface of the electrophotographic photosensitive member 31 after transfer of toner images is not removed by a cleaning means (cleaner) used exclusively therefor, but is temporarily collected on the charging roller 32 which is counter-rotated as the electrophotographic photosensitive member 31 is rotated. Then, while it moves circularly around the periphery of the charging roller 32, the toner whose electric charges having been reversed are normalized is successively thrown out to the electrophotographic photosensitive member 31 and reaches the developing zone a, where it is collected at a developing means 36 by cleaning-at-development and is reused.

Reference numeral 35 denotes a laser beam scanner (exposure means) having a laser diode polygon mirror and so forth. This laser beam scanner 35 emits laser light intensity-modulated correspondingly to time-sequential digital image signals of the intended image information, and subjects the uniformly charged surface of the electrophotographic photosensitive member to scanning exposure L through the laser light. As a result of this scanning exposure L, electrostatic latent images corresponding to the intended image information are formed on the surface of the electrophotographic photosensitive member 31. The electrostatic latent images thus formed are developed by the developing means 36 to form toner images. To the developing means 36, a developing bias is applied from a power source S2.

Reference numeral 38 denotes a fixing means of, e.g., a heat fixing system. A transfer material P which has been fed to a transfer contact zone b between the electrophotographic photosensitive member 31 and a transfer roller 37 and to which the toner images have been transferred under application of a transfer bias from a power source S3 is separated from the surface of the electrophotographic photosensitive member 31. It is then guided into this fixing means 38, where the toner images are fixed, and then put out of the apparatus as an image-formed matter (a print or a copy).

Reference numeral 39 denotes a process cartridge which, in this embodiment, is constituted of the electrophotographic photosensitive member 31, the charging roller 32 and the developing assembly 36 which are integrally supported together in the cartridge, and is detachably mountable on the main body of the apparatus through a guide means such as rails 40 provided in the main body of the apparatus.

The electrophotographic photosensitive member of the present invention may be not only applied in electrophotographic copying machines, but also widely applied in the fields where electrophotography is applied, e.g., laser beam printers, CRT printers, LED printers, facsimile machines, liquid-crystal printers, and laser platemaking.

Examples of the present invention are given below. The present invention is by no means limited to the following Examples. In the following Examples and Comparative Examples, "part(s)" refers to "part(s) by weight".

EXAMPLE 1

On an aluminum cylinder as a conductive support, having an outer diameter of 30 mm and a length of 261 mm, a 5% by weight methanol solution of a polyamide resin (trade name: AMILAN CM8000; available from Toray Industries, Inc.) was applied by dip coating, followed by drying to form a binding layer with a layer thickness of 0.5 $\mu$m.

Next, 3.5 parts of hydroxygallium phthalocyanine crystals having strong peaks at Bragg's angles (2θ±0.2°) of 7.4° and 28.2° in the CuKα characteristic X-ray diffraction and 1 part of polyvinyl butyral resin (trade name: S-LEC BX-1; available from Sekisui Chemical Co., Ltd.) were added to 120 parts of cyclohexanone, and these were dispersed for 3 hours by means of a sand mill making use of glass beads of 1 mm in diameter, and diluted by further addition of 120 parts of ethyl acetate to make a charge generation layer coating dispersion. This coating dispersion was applied onto the above binding layer by dip coating, followed by drying at 100° C. for 10 minutes to form a charge generation layer with a layer thickness of 0.15 $\mu$m.

Figure 4:
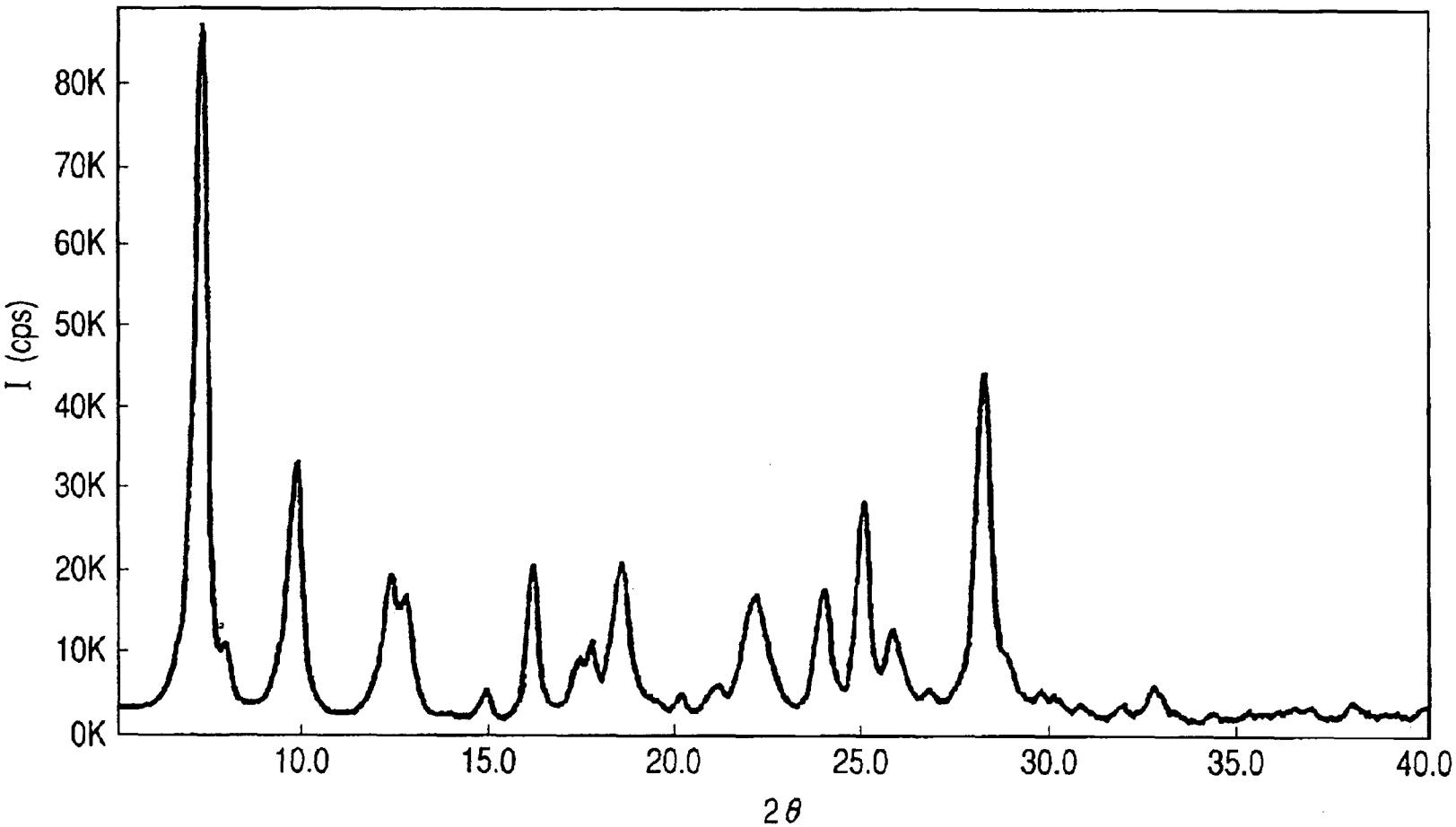
FIG. 4 is a chart of CuKα characteristic X-ray diffraction characteristic of hydroxygallium phthalocyanine used in Examples of the present invention.

A powder X-ray diffraction pattern of the hydroxygallium phthalocyanine crystals is shown in FIG. 4. The powder X-ray diffraction was measured by using CuKα radiations under the following conditions. Measuring instrument used: Full-automatic X-ray diffractometer MXP18, manufactured by Mach Science Co.

X-ray tube: Cu

Tube voltage: 50 kV

Tube current: 300 mA

Scanning method: 2θ/θ scan

Scanning speed: 2 deg./min.

Sampling interval: 0.020 deg.

Start angle (2θ): 5 deg.

Stop angle (2θ): 40 deg.

Divergent slit: 0.5 deg.

Scattering slit: 0.5 deg.

Receiving slit: 0.3 deg.

Curved monochromator was used.

Next, as a charge-transporting material 10 parts of a compound having structure represented by the following formula:

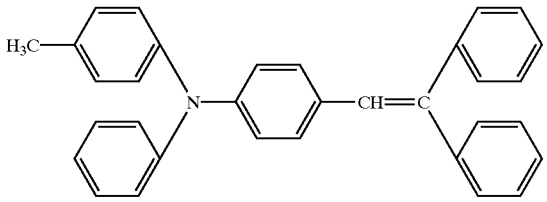

and as a binder resin 10 parts of bisphenol-Z polycarbonate (trade name: IUPILON Z-200; available from Mitsubishi Gas Chemical Company, Inc.) were dissolved in a mixed solvent of 100 parts of monochlorobenzene to prepare a charge transport layer coating solution. This coating solution was applied onto the charge generation layer, and dried with hot air at 105° C. over 1 hour to form a charge transport layer 20 $\mu$m thick.

Next, 20 parts of antimony-doped ultrafine tin oxide particles surface-treated with a compound (amount of treatment: 7%) having structure represented by the following formula:

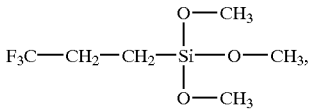

30 parts of antimony-doped fine tin oxide particles surface-treated with methylhydrogen silicone oil (trade name: KF99; available from Shin-Etsu Chemical Co., Ltd.) (treatment amount: 20%) and 150 parts of ethanol were dispersed by means of a sand mill over a period of 66 hours, and 20 parts of fine polytetrafluoroethylene particles (average particle diameter: 0.18 $\mu$m) were further added, followed by dispersion for 2 hours. Thereafter, in the resultant dispersion, 30 parts of resol type heat-curable phenolic resin (trade name: PL-4804; containing an amine compound; available from Gunei Kagaku Kogyo K.K.) was dissolved as a resin component to prepare a coating solution for a protective layer. This coating solution was applied onto the charge transport layer, and dried with hot air at 145° C. over 1 hour to form a protective layer.

The thickness of this protective layer was measured by the use of an instantaneous multi-photometry system MCPD-2000 (manufactured by Ohstuka Denshi K.K.) utilizing light interference, and found to be 3 $\mu$m. Dispersibility of the coating solution for the protective layer is desirable, and the visual detection of the protective layer surface showed that the surface was free of unevenness and uniform.

The Vsl(0.2) and Vsl(0.5) of the resulting electrophotographic photosensitive member were measured with a drum testing machine (manufactured Jentech Co.). In the measurement, the electrophotographic photosensitive member surface was charged to −700 V under the 23° C./5% RH environment, and irradiated with white light in the light quantity of 10 lux·sec. A potential-measuring probe was set at positions of 90° and 224.5° from the position where the white light was irradiated, and the probe at the 90° position and the probe at the 224.5° position measured the Vsl(0.2) and the Vsl(0.5), respectively.

The above-obtained electrophotographic photosensitive member was mounted on a remodeled apparatus of the electrophotographic apparatus (trade name: Laser Jet 4000, manufactured by Hewllet-Pachard Co.) that was in the same system as in the above embodiment 1, and image evaluation was made. The principal remodeling point was in that the system was so constructed as to be the same as in the above embodiment 2.

The charging particles had a volume resistivity of 1 Ω·cm and the carried amount at the initial stage was 5 mg/cm$^2$. The voltage applied to the charging member from the power source S1 was only a DC voltage of −700 V.

Under the above conditions, the dark portion potential (Vd) at the initial stage was measured in a normal temperature and low humidity environment (23° C./5% RH). The images obtained were evaluated by visual observation. In addition, for durability tests, evaluation was made by visual observation on images obtained after carrying out 5,000-sheet image formation under a normal temperature and low humidity environment (23° C./5% RH) and a high temperature and high humidity environment (32° C./85% RH). When the durability test was carried out, a letter image with a print rate of 6% was used, and when the evaluation was made, an image was used in which a portion corresponding to the first ⅓ rotation of the photosensitive member is solid black and the remaining portion is of a half-tone comprised of dotted lines arranged every second line in which each of the dotted lines is composed of black dots of 1,200 dpi arranged every second dot and the dot arrangements of adjacent dotted lines are opposite to each other.

The evaluation results are shown in Table 1.

EXAMPLE 2

The electrophotographic photosensitive member was evaluated in the same way as in Example 1 except that the electrophotographic apparatus was used without being remodeled into the construction in the embodiment 2. The results obtained are shown in Table 1.

EXAMPLES 3 and 4

Eelectrophotographic photosensitive members were made in the same way as in Example 1 except that the resole-type phenol resin (trade name: PL-4804) was changed to each of a resole-type phenol resin PL-4852 (produced by Gunei Kagaku Kogyo K.K., containing an amine-type compound) (Example 3) and a resole-type phenol resin PL-5294 (produced by Gunei Kagaku Kogyo K.K., containing an alkaline metal) (Example 4). The results obtained are shown in Table 1.

EXAMPLES 5 and 6

The electrophotographic photosensitive member was evaluated in the same way as in Examples 3 and 4 except that the electrophotographic apparatus was used without being remodeled into the construction in the embodiment 2. The results obtained are shown in Table 1.

EXAMPLES 7 and 8

An electrophotographic photosensitive member was made in the same way as in Example 1 except that the resole-type phenol resin (trade name: PL-4804) was changed to a bisphenol A-type epoxy resin (trade name: R309, produced by Mitsui Petrochemical Industries, Ltd.), the solvent was changed from ethanol to tetrahydrofuran, and the coating method for forming the protective layer was changed from the dipping method to a spray coating method, and evaluations in Examples 7 and 8 were made in the same way as in Examples 1 and 2, respectively. The results obtained are shown in Table 1.

EXAMPLES 9 and 10

An electrophotographic photosensitive member was made and evaluated in the same way as in Examples 7 and 8 except that the amount of bisphenol A-type epoxy resin used was changed from 30 parts to 40 parts. The results obtained are shown in Table 1.

EXAMPLES 11 and 12

An electrophotographic photosensitive member was made and evaluated in the same way as in Examples 9 and 10 except that the thickness of the protective layer was changed from 3 μm to 5 μm. The results obtained are shown in Table 1.

EXAMPLES 13 and 14

An electrophotographic photosensitive member was made and evaluated in the same way as in Examples 9 and 10 except that the thickness of the protective layer was changed from 3 μm to 5.5 μm. The results obtained are shown in Table 1.

COMPARATIVE EXAMPLES 1 and 2

An electrophotographic photosensitive member was made and evaluated in the same way as in Examples 9 and 10 except that the amount of bisphenol A-type epoxy resin used was changed from 40 parts to 50 parts and the thickness of the protective layer was changed from 3 μm to 6.5 μm. The results obtained are shown in Table 1.

COMPARATIVE EXAMPLES 3 and 4

An electrophotographic photosensitive member was made and evaluated in the same way as in Examples 7 and 8 except that the amount of bisphenol A-type epoxy resin used was changed from 30 parts to 55 parts. The results obtained are shown in Table 1.

COMPARATIVE EXAMPLES 5 and 6

An electrophotographic photosensitive member was made and evaluated in the same way as in Examples 7 and 8 except that the amount of bisphenol A-type epoxy resin used was changed from 30 parts to 10 parts. The results obtained are shown in Table 1.

EXAMPLE 15

An electrophotographic photosensitive member was made and evaluated in the same way as in Example 5 except that instead of adding tin oxide particles, 30 parts of a charge transporting material represented by the following formula was added to form the protective layer. The results obtained are shown in Table 1.

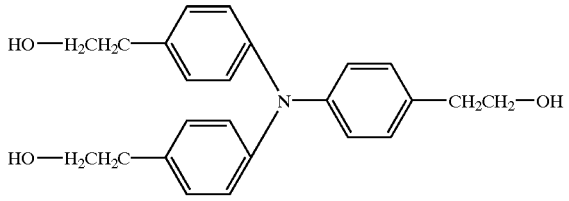

EXAMPLE 16

An electrophotographic photosensitive member was made and evaluated in the same way as in Example 15 except that the resole-type phenol resin (trade name: PL-4852) was changed to a curable siloxane resin KP-854 (produced by Shin-Etsu Chemical Co.,Ltd.). The results obtained are shown in Table 1.

EXAMPLE 17

An electrophotographic photosensitive member was made and evaluated in the same way as in Example 16 except that the thickness of the protective layer was changed from 3 μm to 5.5 μm. The results obtained are shown in Table 1.

COMPARATIVE EXAMPLE 7

An electrophotographic photosensitive member was made and evaluated in the same way as in Example 16 except that the amount of curable siloxane resin used was changed from 30 parts to 40 parts and the thickness of the protective layer was changed from 3 μm to 6.5 μm. The results obtained are shown in Table 1.

COMPARATIVE EXAMPLE 8

An electrophotographic photosensitive member was made and evaluated in the same way as in Example 16 except that the amount of charge-transporting material added was changed from 30 parts to 70 parts. The results obtained are shown in Table 1.

COMPARATIVE EXAMPLE 9

An electrophotographic photosensitive member was made and evaluated in the same way as in Example 16 except that the amount of charge-transporting material added was changed from 30 parts to 10 parts and the thickness of the protective layer was changed from 3 μm to 6.5 μm. The results obtained are shown in Table 1.

COMPARATIVE EXAMPLE 10

An electrophotographic photosensitive member was made and evaluated in the same way as in Example 17 except that as a charge-generating compound used was a hydroxytitanium phthalocyanine crystal having intense peaks at 7.6°, 10.2°, 25.3° and 28.6° of the Bragg angle (2θ±0.2°) in $CuK_\alpha$ characteristic X-ray diffraction. The results obtained are shown in Table 1.

EXAMPLE 18

An electrophotographic photosensitive member was made and evaluated in the same way as in Example 7 except that the voltage applied to the charging roller was changed from the only DC voltage to a voltage composed of a DC voltage of −700 V superposed on an AC voltage whose peak-to-peak voltage is 500 V. The results obtained are shown in Table 1.

COMPARATIVE EXAMPLE 11

An electrophotographic photosensitive member was made and evaluated in the same way as in Comparative Example 2 except that the voltage applied to the charging roller was changed from the only DC voltage to a voltage composed of a DC voltage of −700 V superposed on an AC voltage whose peak-to-peak voltage is 500 V. The results obtained are shown in Table 1.

COMPARATIVE EXAMPLE 12

An electrophotographic photosensitive member was made and evaluated in the same way as in Example 16 except that the amount of curable siloxane resin used was changed from 30 parts to 45 parts and the thickness of the protective layer was changed from 3 μm to 2 μm. The results obtained are shown in Table 1.

TABLE 1

| | Initial stage | | Drum tester | | | Image evaluation | |
|---|---|---|---|---|---|---|---|
| | Vd (V) | Image evaluation | Vsl (0.2) (V) | Vsl (0.5) (V) | \|Vsl (0.2) − Vsl (0.5)\| (V) | After extensive operation in environment of: Low humidity | High humidity |
| Example: | | | | | | | |
| 1 | −590 | Good. | −55 | −40 | 15 | Good. | Good. |
| 2 | −580 | Good. | −55 | −40 | 15 | Good. | Good. |
| 3 | −590 | Good. | −50 | −36 | 14 | Good. | Good. |
| 4 | −590 | Good. | −60 | −30 | 30 | Good. | Good. |
| 5 | −580 | Good. | −50 | −36 | 14 | Good. | Good. |
| 6 | −580 | Good. | −58 | −38 | 20 | Good. | Good. |
| 7 | −590 | Good. | −55 | −30 | 25 | Good. | Good. |
| 8 | −580 | Good. | −55 | −30 | 25 | Good. | Good. |
| 9 | −580 | Good. | −70 | −44 | 26 | Good. | Slight positive ghost. |
| 10 | −590 | Good. | −70 | −44 | 26 | Good. | Slight positive ghost. |
| 11 | −570 | Good. | −75 | −47 | 28 | Good. | Slight positive ghost. |
| 12 | −575 | Good. | −75 | −47 | 28 | Good. | Slight positive ghost. |
| 13 | −565 | Good. | −77 | −47 | 30 | Slight positive ghost. | Slight positive ghost. |
| 14 | −570 | Good. | −77 | −47 | 30 | Slight positive ghost. | Slight positive ghost. |

TABLE 1-continued

| | Initial stage | | Drum tester | | | Image evaluation | |
|---|---|---|---|---|---|---|---|
| | Vd (V) | Image evaluation | Vsl (0.2) (V) | Vsl (0.5) (V) | \|Vsl (0.2) − Vsl (0.5)\| (V) | After extensive operation in environment of: Low humidity | High humidity |
| 15 | −580 | Good. | −45 | −33 | 12 | Good. | Good. |
| 16 | −580 | Good. | −20 | −10 | 10 | Slight negative ghost. | Slight negative ghost. |
| 17 | −580 | Good. | −60 | −30 | 30 | Slight positive ghost. | Good. |
| 18 | −595 | Good. | −55 | −30 | 25 | Good. | Good. |
| Comparative Example: | | | | | | | |
| 1 | −575 | Good. | −80 | −48 | 32 | Positive ghost. | Positive ghost. |
| 2 | −570 | Good. | −80 | −48 | 32 | Positive ghost. | Positive ghost. |
| 3 | −560 | Positive ghost. | −85 | −50 | 35 | Positive ghost. | Positive ghost. |
| 4 | −570 | Positive ghost. | −85 | −50 | 35 | Positive ghost. | Positive ghost. |
| 5 | −590 | Good. | −20 | −12 | 8 | Negative ghost. | Good. |
| 6 | −580 | Good. | −20 | −12 | 8 | Negative ghost. | Good. |
| 7 | −580 | Good. | −70 | −35 | 35 | Positive ghost. | Positive ghost. |
| 8 | −580 | Good. | −12 | −8 | 4 | Negative ghost. | Good. |
| 9 | −580 | Negative ghost. | −95 | −80 | 15 | Negative ghost. | Good. |
| 10 | −570 | Good. | −85 | −50 | 35 | Positive ghost. | Positive ghost. |
| 11 | −100 | Black images. | −80 | −48 | 32 | — | — |
| 12 | −580 | Good. | −55 | −22 | 33 | Good. | Positive ghost. |

As stated above, the present invention has made it possible to provide the electrophotographic photosensitive member that can stably provide high grade images which have almost no positive ghosts and negative ghosts caused by extensive operation in repeated use and also are free of blurred images, and the process cartridge and electrophotographic apparatus having that electrophotographic photosensitive member.

What is claimed is:

1. An electrophotographic photosensitive member comprising, in this order, a photosensitive layer and a protective layer on a conductive substrate, the photosensitive layer comprising a binder resin, a charge-generating material and a first charge transport material and the protective layer comprising a cured resin and a second charge transport material, the photosensitive layer and the protective layer being in contact with each other, wherein the electrophotographic photosensitive member has Vsl(0.2) and Vsl(0.5) which are surface potentials of the electrophotographic photosensitive member, respectively, 0.2 second and 0.5 second after irradiation of the electrophotographic photosensitive member which has been charged to −700V with white light in a quantity of 10 lux.sec under a 23° C. and 75% RH environment and wherein Vsl(0.2) and Vsl(0.5) satisfy the following formulas (1) and (2), $$20(V) \leqq |Vsl(0.2)| \leqq 80(V) \quad (1)$$

$$10(V) \leqq |Vsl(0.2) - Vsl(0.5)| \leqq 30(V) \quad (2)$$

and wherein the second charge transporting material is at least one compound represented by any one of the following formulas (2) to (7):

(2)

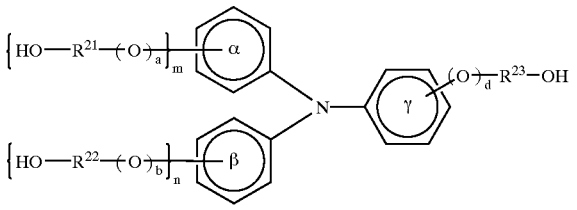

wherein $R^{21}$, $R^{22}$ and $R^{23}$ are each independently a divalent, branched or unbranched hydrocarbon group having 1 to 8 carbon atoms; benzene rings α, β and γ may each independently have a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; and a, b, d, m and n are each independently 0 or 1, (3)

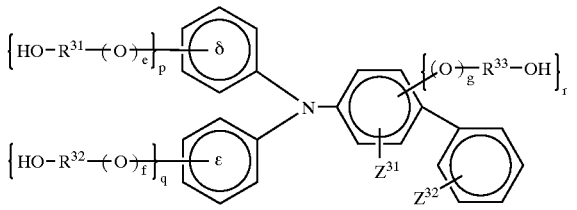

wherein $R^{31}$, $R^{32}$ and $R^{33}$ are each independently a divalent, branched or unbranched hydrocarbon group having 1 to 8 carbon atoms; benzene rings δ and ε may each independently have a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; e, f and g are each independently 0 or 1; p, q and r are each independently 0 or 1 provided that all of them are not 0 at the same time; and $Z^{31}$ and $Z^{32}$ are each independently a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or are combined together to form a ring, (4)

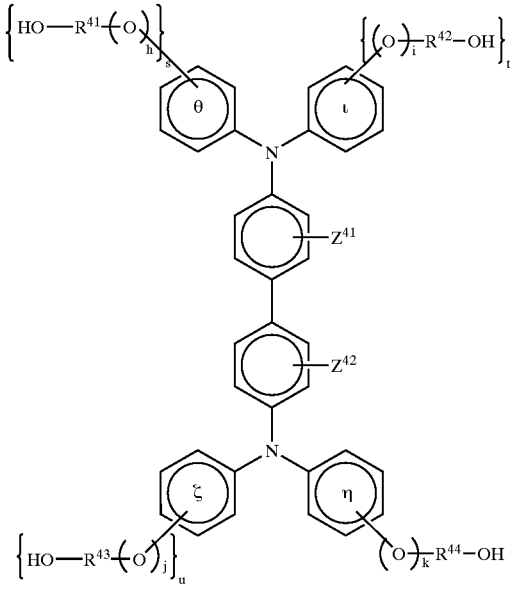

wherein $R^{41}$, $R^{42}$, $R^{43}$ and $R^{44}$ are each independently a divalent, branched or unbranched hydrocarbon group having 1 to 8 carbon atoms; benzene rings ζ, η, θ and ι may each independently have a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group; h, i, j, k, s, t and u are each independently 0 or 1; and $Z^{41}$ and $Z^{42}$ are each independently a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or are combined together to form a ring, (5)

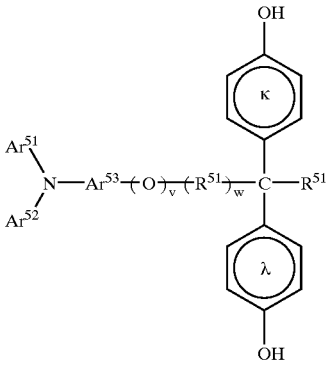

wherein $R^{51}$ is a divalent, branched or unbranched hydrocarbon group having 1 to 8 carbon atoms; $R^{52}$ is a hydrogen atom, a substituted or unsubstituted alkyl group, a substituted or unsubstituted aralkyl group or a substituted or unsubstituted phenyl group; $Ar^{51}$ and $Ar^{52}$ are each independently a substituted or unsubstituted alkyl group, a substituted or unsubstituted aralkyl group or a substituted or unsubstituted aromatic hydrocarbon ring group or a substituted or unsubstituted aromatic heterocyclic group; $Ar^{53}$ is a divalent, substituted or unsubstituted aromatic hydrocarbon ring group or a divalent, substituted or unsubstituted aromatic heterocyclic group; v and w are each independently 0 or 1 provided that when v is 0, w is 0; and benzene rings κ and λ may each independently have a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, (6)

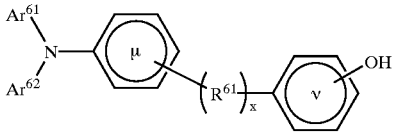

wherein $R^{61}$ is a divalent, branched or unbranched hydrocarbon group having 1 to 8 carbon atoms; $Ar^{61}$ and $Ar^{62}$ are each independently a substituted or unsubstituted alkyl group, a substituted or unsubstituted aralkyl group, a substituted or unsubstituted aromatic hydrocarbon ring group or a substituted or unsubstituted aromatic heterocyclic group; x is 0 or 1; benzene rings μ and ν may each independently have a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or may be combined together to form a ring through a substituent;

(7)

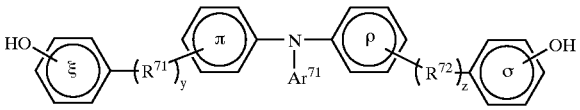

wherein $R^{71}$ and $R^{72}$ are each independently a divalent, branched or unbranched hydrocarbon group having 1 to 8 carbon atoms; $Ar^{71}$ is a substituted or unsubstituted alkyl group, a substituted or unsubstituted aralkyl group, a substituted or unsubstituted aromatic hydrocarbon ring group or a substituted or unsubstituted aromatic heterocyclic group; y and z are each independently 0 or 1; benzene rings ξ, π, ρ and σ may each independently have a halogen atom, a substituted or unsubstituted alkyl group, a substituted or unsubstituted alkoxyl group, a substituted or unsubstituted aromatic hydrocarbon ring group or a substituted or unsubstituted aromatic heterocyclic group, or the benzene rings ξ and π and the benzene rings ρ and σ may be each independently combined together to form a ring through a substituent.

2. The electrophotographic photosensitive member according to claim 1, wherein the Vsl(0.2) is 20 (V) or more and 70 (V) or less.

3. The electrophotographic photosensitive member according to claim 1, wherein the Vsl(0.2) is 20 (V) or more and 60 (V) or less.

4. The electrophotographic photosensitive member according to claim 1, wherein the protective layer has a thickness of 1 to 5.5 $\mu$m.

5. The electrophotographic photosensitive member according to claim 1, wherein the photosensitive layer contains hydroxygallium phthalocyanine.

6. A process cartridge comprising the electrophotographic photosensitive member of claim 1 and a charging means which are integrally held together and are detachably mountable on a main body of an electrophotographic apparatus.

7. An electrophotographic apparatus comprising an electrophotographic photosensitive member of claim 1, a charging means, an exposure means, a developing means and a transfer means.

* * * * *